US012690661B2

(12) United States Patent
Liao

(10) Patent No.: US 12,690,661 B2
(45) Date of Patent: Jul. 28, 2026

(54) BACKPACK

(71) Applicant: Zhifeng Liao, Guangzhou (CN)

(72) Inventor: Zhifeng Liao, Guangzhou (CN)

( * ) Notice: Subject to any disclaimer, the term of this patent is extended or adjusted under 35 U.S.C. 154(b) by 102 days.

(21) Appl. No.: 18/759,730

(22) Filed: Jun. 28, 2024

(65) Prior Publication Data

US 2024/0349876 A1 Oct. 24, 2024

Related U.S. Application Data

(63) Continuation of application No. PCT/CN2022/000154, filed on Dec. 6, 2022.

(30) Foreign Application Priority Data

Jan. 7, 2022 (CN) ..... 202210012212.6

(51) Int. Cl.
*A45F 3/08* (2006.01)
*A45F 3/04* (2006.01)

(52) U.S. Cl.
CPC ..... *A45F 3/08* (2013.01); *A45F 3/047* (2013.01)

(58) Field of Classification Search
CPC ..... A45C 13/00; A45F 2003/122; A45F 2003/125; A45F 3/04; A45F 3/047; A45F 3/06; A45F 3/08; A45F 3/10; A45F 3/14
USPC ..... 224/628
See application file for complete search history.

(56) References Cited

U.S. PATENT DOCUMENTS 2,560,406 A * 7/1951 Bergsland ..... A45F 3/04 224/636
4,089,447 A * 5/1978 Achmeteli ..... A45F 3/10 224/644
5,823,414 A 10/1998 Sa
2003/0000985 A1 1/2003 Schroeder
2009/0321481 A1* 12/2009 Licausi ..... A45F 3/047 224/262

FOREIGN PATENT DOCUMENTS

CN 2123918 U 12/1992
CN 201905426 U 7/2011
(Continued)

OTHER PUBLICATIONS

WO-03101244-A1 Translation, Buffinton Stephan, Dec. 11, 2003 (Year: 2003).*

(Continued)

*Primary Examiner* — Nathan J Newhouse
*Assistant Examiner* — Matthew T Theis

(57) ABSTRACT

A backpack is provided. The backpack includes: a longitudinal supporting element, a first end of which is opposite to the shoulder and the second end opposite to a waist of the user; a main body includes a top end, a middle part and a bottom end; the main body is inclined relative to the longitudinal supporting element; and a transverse connector connects the longitudinal supporting element to the main body, and maintains the inclination of the main body relative to the longitudinal supporting element. A portion weight of the main body is shared by the waist or back, reducing the pressure on the shoulders and achieving a load reduction effect. And the inclination creates a backward stretching force on the shoulders, thereby correcting the curvature of the shoulders and back.

20 Claims, 28 Drawing Sheets

(56) References Cited

FOREIGN PATENT DOCUMENTS

| | | | | | |
|---|---|---|---|---|---|
| CN | 202085927 | U | | 12/2011 | |
| CN | 204797010 | U | | 11/2015 | |
| CN | 109549329 | A | | 4/2019 | |
| CN | 209915270 | U | | 1/2020 | |
| CN | 211431447 | U | | 9/2020 | |
| CN | 211608485 | U | | 10/2020 | |
| CN | 112806705 | A | | 5/2021 | |
| CN | 213664123 | U | | 7/2021 | |
| CN | 214230252 | U | | 9/2021 | |
| CN | 214547925 | U | | 11/2021 | |
| CN | 214630652 | U | | 11/2021 | |
| CN | 214677995 | U | | 11/2021 | |
| CN | 214711081 | U | | 11/2021 | |
| CN | 214855012 | U | | 11/2021 | |
| EP | 0628265 | A1 | | 12/1994 | |
| JP | 2021023507 | A | | 2/2021 | |
| NL | 1028275 | C1 | * | 8/2006 | ..... A47D 13/02 |
| WO | WO-03101244 | A1 | * | 12/2003 | ..... A47D 11/00 |
| WO | WO-2012153334 | A1 | * | 11/2012 | ..... A45F 3/10 |
| WO | 2017007222 | A1 | | 1/2017 | |

OTHER PUBLICATIONS

NL-1028275-C1 Translation, Diggelen Marinus Van, Aug. 15, 2006 (Year: 2006).*

Internation Search Report of PCT/CN2022/000154, Mailed Feb. 28, 2023.

* cited by examiner

BACKPACK

CROSS REFERENCE TO RELATED APPLICATIONS

This application is a national stage filing under 35 U.S.C. § 371 of international application number PCT/CN2022/000154, filed Dec. 6, 2022, which claims priority to Chinese patent application No. 202210012212.6, filed Jan. 7, 2022. The contents of these applications are incorporated herein by reference in their entirety.

TECHNICAL FIELD

The present disclosure relates to the technical field of bag, in particular to a backpack.

BACKGROUND

The body of the traditional backpack is close to the user's back, and the weight of the backpack is completely applied to the shoulder. Long-term weight bearing will lead to injury and discomfort of the shoulder and back, and severe cases will cause deformation of the spine and scapula, causing deformation of hunchback or shoulder. To some extent, the backpack can relieve the shoulder stress and improve the comfort of users.

For example, Chinese Patent CN 214855012 U provides a force suspension during multifunctional backpack, with two ends of the shoulder belt and the three strip interrupted elastic strip formed six elastic points, and can be forced stretch at the same time, through the elastic stretch pull backpack ontology to produce suspension feeling, to reduce the weight on the user, so as to realize the effect of reducing load. Similar designs are also shown in Chinese Patents CN 214677995 U, CN 214547925 U, CN 214230252 U and CN 213664123 U, etc. However, these backpacks are always in an upper and lower movement state during using. Although the upper movement can reduce part of the pressure on the shoulder, the pressure on the shoulder is bound to increase in the downward movement, its decompression effect is limited, and the backpack is uncomfortable for using.

Chinese Patent CN 214630652 U discloses an airbag typed decompression backpack, by installing the airbag pressurizing device and other components to the backpack, through a built-in inflation pump to inflate the airbag, combined with the inner flexible belt and other components, can achieve the effect of buffer, decompression and auxiliary support, so as to better protect the human spine. However, the pressurization device, the inflation pump and the inflation line themselves will cause an additional burden, making the burden reduction less effective as expected.

Chinese Patent CN 112806705 A discloses a mechanical suspension load reduction backpack, the backpack is equipped with a mounting board, transmission system and energy storage device, the transmission system and the energy storage device are simultaneously connected to the mounting plate, by setting the gear and rack between the mounting plate and the drive system, with the mounting plate and the transmission system while walking, relatively sliding as the backplane moves up and down. At the same time, the sliding up and down of the mounting plate repeats the process of forming storage and releasing storage. The forces formed during this process counteract the action of the backpack to overcome gravity, to achieve the burden reduction effect on the user's shoulder. However, the backpack's transmission system and energy storage device itself can pose an additional heavy burden, and the mechanical design is too complex, and the production and maintenance costs are too high.

In view of this, it is necessary to provide a simple and comfortable backpack to overcome the defects of the existing technology, which can not only reducing the burden on the shoulder, but also correcting the shoulder and back.

SUMMARY

The present disclosure provides a backpack, the backpack includes a longitudinal supporting element, a main body and at least one transverse connector; the longitudinal supporting element includes a first end and a second end, and an intermediate portion is connected the first end to the second end; when the backpack is carried on a shoulder of an user, the first end is opposite to the shoulder and the second end opposite to a waist of the user; the main body is independent of the longitudinal supporting element, the main body includes a top end, a middle part and a bottom end; the top end is opposite to the first end, and the bottom end is opposite to the second end, and a middle part is connected the top end to the bottom end; the main body is inclined relative to the longitudinal supporting element; and the transverse connector is configured to connect the longitudinal supporting element to the main body, and at least partially maintaining the inclination of the main body relative to the longitudinal supporting element; and a first lateral spacing between the first end and the top end is greater than a second lateral spacing between the second end and the bottom end.

In some embodiments, the inclined angle (the inclined angle of the main body relative to the longitudinal supporting element) is variable; In some embodiments, the inclined angle is varied at equal intervals, such as 5°; in some embodiments, the inclined angle is varied between 0° and 90°; in some embodiments, the inclined angle is varied between 15° and 45°; in some embodiments, the inclined angle is varied between 15° and 30°; in some embodiments, the inclined angle is 5°, 15°, 30°, 45° or 60°.

In some embodiments, the main body is switched between inclination and non inclination position. For example, in a non inclination position, the main body is parallel and adheres to the longitudinal supporting element in the longitudinal direction. For example, in a inclination position, the inclined angle of inclination can be fixed (e.g.) 30° or variable (e.g. the variation method described above).

In some embodiments, the transverse connector includes a first connecting part connected to the longitudinal supporting element, a second connecting part connected to the main body, and an intermediate connecting part, and the intermediate connecting part is configured to connect the first connecting part and the second connecting part; a spacing between the first connecting part and the second connecting part decreases gradually from the first end of the longitudinal supporting element to the second end; in some embodiment, the intermediate connecting part is located on an end portion of the first connecting part and the second connecting part; in some embodiment, the intermediate connecting part is located on a middle portion of the first connecting part and the second connecting part.

In some embodiments, the backpack further includes a supporting component independent of the transverse connector, the supporting component is extended by the longitudinal supporting element and at least partially supporting the main body; in some embodiments, the inclined angle of the main body relative to the longitudinal supporting element is changed; in some embodiments, inclined angle of the main body relative to the longitudinal supporting element is fixed.

In some embodiments, the supporting component is located on the middle portion of the intermediate portion of the longitudinal supporting element and the middle part of the main body, and the supporting component is horizontally extended by the longitudinal supporting element for a first distance to increase a second horizontal spacing.

In some embodiments, the supporting component is connected between the second end of the longitudinal support member and the bottom end of the package body; in some embodiments, the support member extends laterally from the second end of the longitudinal support member, and the package body is provided on the support member.

In some embodiments, the supporting component of the backpack is elastic or buffer components, such as springs or airbags.

In some embodiments, the main body is disposed on the supporting component by the first intermediate connector, the first intermediate connector includes a first part and a second part, an angle between the first part and the second part is changeable.

In some embodiments, the main body is disposed on the supporting component by the first intermediate connector, the first intermediate connector is in a wedge shape with an oblique surface touching the bottom end of the main body; in some embodiment, an inclined angle between the oblique surface and the supporting component is variable.

In some embodiments, the transverse connector is formed by a filling material; in some embodiments, the transverse connector is formed of filling material and the bottom end of the main body is also filled with wedge-shaped filling material to maintain the inclination of the main body together with the transverse connector.

In some embodiments, a lateral width of the transverse connector is adjusted at predetermined intervals.

In some embodiments, transverse connector is a connector that is at least partially rigid, for example, the lateral connector include but is not limited to connecting rod, hinge, gemel, triangular plate, airbag, etc., whose lateral width is adjustable or not adjustable.

In some embodiments, the transverse connector is a textile object surrounding and connecting the main body to the longitudinal supporting element, for example, the main body is screwed to the textile object that is surrounded the transverse connector by suture line.

In some embodiments, one or more or all of the longitudinal supporting element, the transverse connector and the supporting component are hidden; or one or more or all of the longitudinal supporting element, the transverse connector and the supporting component are exposed; in some embodiment, the backpack includes a zipper located between the longitudinal supporting element and the main body, the closing and pulling of the zipper resulting in hidden and exposure of the transverse connector.

In some embodiments, an internal space of the main body is separated into at least two subspaces by at least one hard sheet; in some embodiments, the side edges of the bag body have at least one hard sheet material as the inner lining, thereby maintaining the rigidity of the main body;

In some embodiments, the backpack also includes a strap connected to the longitudinal supporting element and a strip connecting the main body to the strap, the strip is connected to the strap in different locations.

The backpack of the present application includes independent main body and longitudinal supporting element, the top end of the main body is inclined relative to the longitudinal supporting element at a direction of away from the longitudinal supporting element, the bottom end of the main body against to the longitudinal supporting element and connects to the longitudinal supporting element through the supporting component. On one hand, a portion of the weight of the main body is shared by the waist or back, reducing the pressure on the shoulders and achieving a load reduction effect; on the other hand, the main body inclines to the right creates a backward stretching force on the shoulders, thereby correcting the curvature of the shoulder and back. The backpack of the present application can be used as a school bag, a travelling bag, a hiking bag, and other various scenarios.

BRIEF DESCRIPTION OF THE DRAWINGS

The present disclosure will be described in more detail with reference to the accompanying drawings. It should be noted that the illustrated drawings are only used as representative examples of the embodiments of the disclosure, and to more clearly explaining the details of the exemplary embodiment, the elements in the attached drawings are not drawn in proportion to the actual size, but the number of actual elements can change, the relative position of the actual elements is basically consistent with the diagram, and some elements are not shown. In the presence of multiple embodiments, when one or more features described in the previous embodiment may also be applied to another embodiment, in the latter one or more embodiments, the latter one or more embodiments shall be understood as the reproducible applicable features have been described, unless otherwise noted. Those skilled in the art will realize after reading the present disclosure that one or more features displayed in one figure may be combined with one or more features in another drawing to construct one or more alternative embodiments not specifically shown in the drawings, which also form part of the present disclosure.

DETAILED DESCRIPTION OF THE EMBODIMENTS

The technical solutions in the embodiments of the present disclosure will be described clearly and completely with reference to the accompanying drawings in the embodiments of the present disclosure. Obviously, the described embodiments are only a part of the embodiments of the present disclosure rather than all of them. Based on the embodiments in the present disclosure, all other embodiments obtained by those skilled in the art without creative work shall fall within the scope of protection of the present disclosure.

Figure 1A:
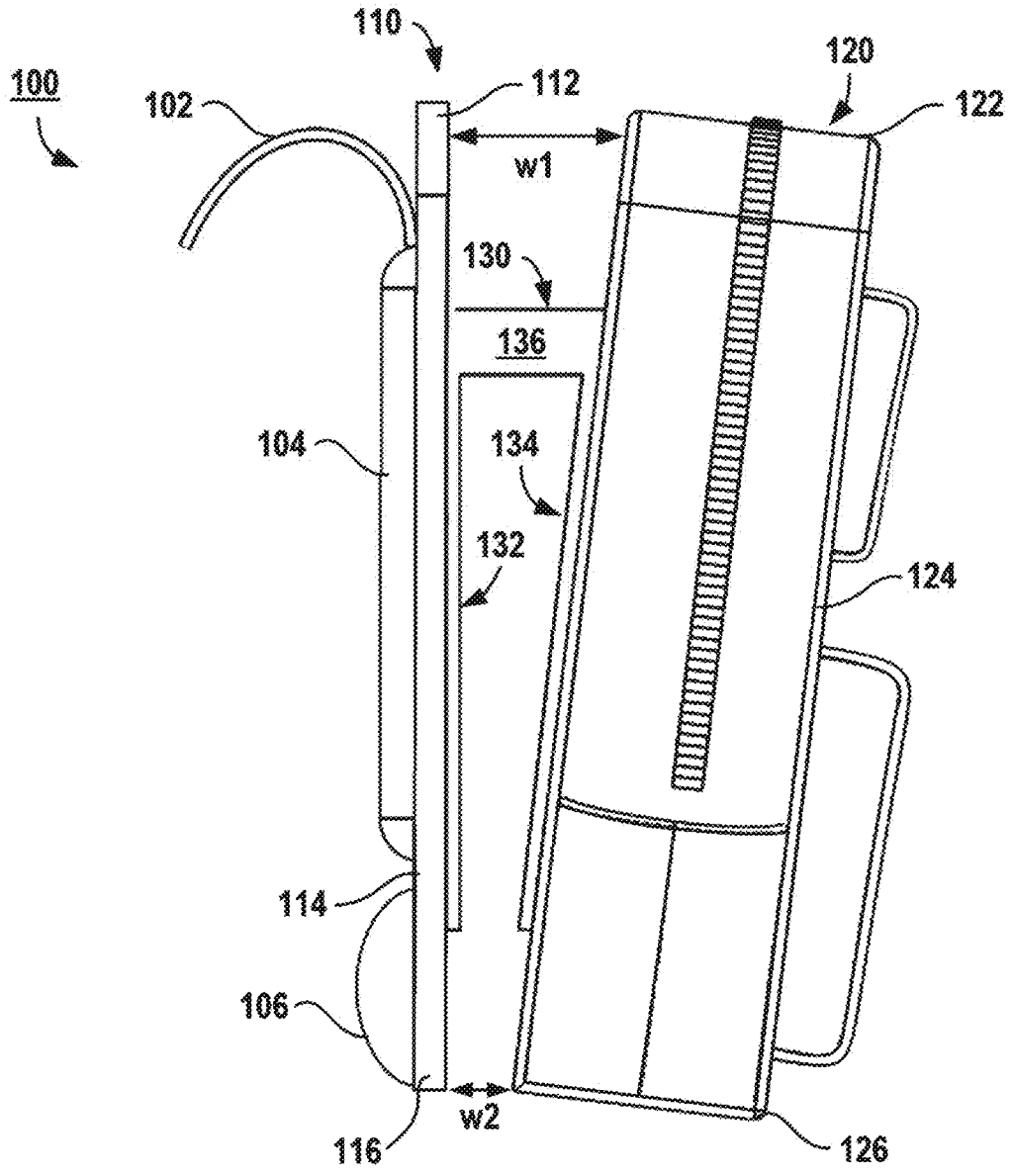
FIG. 1A is a side view of a backpack of a first embodiment of the present disclosure.
Figure 1B:
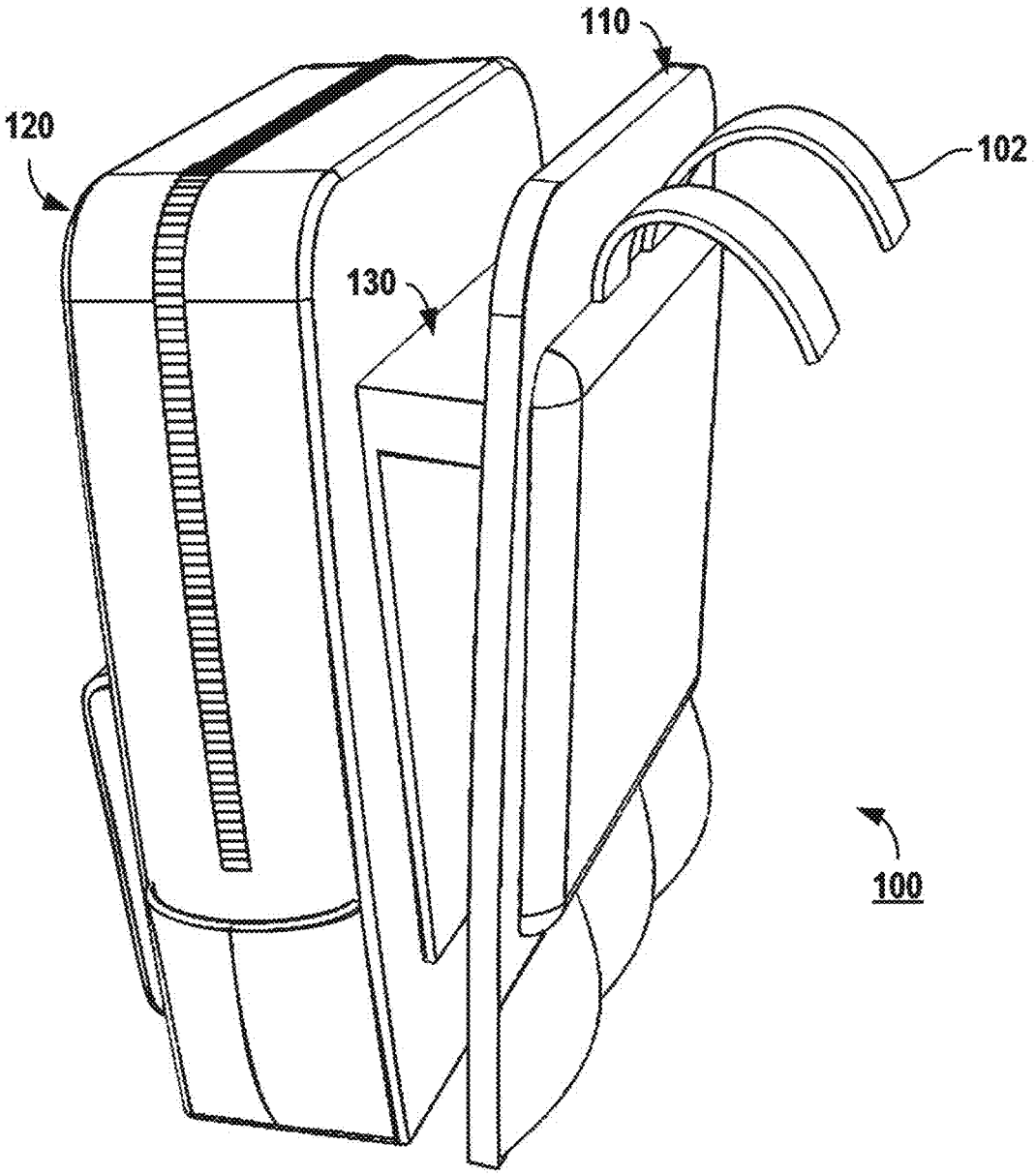
FIG. 1B is a perspective view of the backpack of the first embodiment of the present disclosure.

FIGS. 1A and 1B show a side view and a perspective view of a backpack of a first embodiment of the present disclosure, respectively. The backpack 100 includes a longitudinal supporting element 110, a main body 120 and a transverse connector 130. The longitudinal supporting element 110 includes a first end 112 and a second end 116, and an intermediate portion 114 is connected the first end 112 to the second end 116; when the backpack is carried on a shoulder of an user, the first end 112 is opposite to the shoulder and the second end 116 opposite to a waist of the user. The longitudinal supporting element 110 is usually a plate-like structure composed of hard materials or has a hard skeleton to withstand the partial gravity of the main body 120 without deformation. Hard materials or frameworks, such as lightweight plastics, can be wrapped in textiles or exposed to the outside world.

The main body 120 is independent of the longitudinal supporting element 110, and the main body 120 is configured to accommodate items. The shape of the main body is usually a rectangular shape, and it can also be other suitable three-dimensional shapes. The main body 120 comprising a top end 122, a middle part 124 and a bottom end 126, and the top end 122 is opposite to the first end 112, and the bottom end 126 is opposite to the second end 116, and a middle part 124 is connected the top end 122 to the bottom end 126. And the main body 120 is inclined to the longitudinal supporting element 110.

The transverse connector 130 is configured to connect the longitudinal supporting element 110 to the main body 110, and at least partially maintaining the inclination of the main body 120 relative to the longitudinal supporting element 110. A first lateral spacing w1 between the first end 112 and the top end 122 is greater than a second lateral spacing w2 between the second end 116 and the bottom end 126, so the main body 120 is inclined to the right side relative to the longitudinal supporting element 110 as shown in the FIGS. 1A and 1B.

In the present embodiment, the transverse connector 130 includes a first connecting part 132 connected to the longitudinal supporting element 110, a second connecting part 134 connected to the main body 120, and an intermediate connecting part 136 that configured to connect the first connecting part 132 and the second connecting part 134. In order to maintain state of the main body 120 inclined to the longitudinal supporting element 110, the spacing between the first connecting part 132 and the second connecting part 134 decreases gradually at a vertically direction (a length direction of the longitudinal supporting element 110) from the first end 112 of the longitudinal supporting element 110 to the second end 116. A person having ordinary skill in the art can understand that, the transverse connector 130 is not limited in the structures shown in the figures, for example, the intermediate connecting part 136 of the transverse connector 130 can set on the middle of the first connecting part 132 and the second connecting part 134, but not set on the end that show in the figures. The transverse connector 130 is usually rigid, for example, the transverse connector 130 is made by hard materials, such as hard plastic, to fix the main body 120 incline to the longitudinal supporting element 110.

An included angle of the main body 120 to the longitudinal supporting element 110 is varied from 0° to 90°, such as 15° to 45°, 15° to 30°, or 30°. The value of the included angle is depended on the setting of the transverse connector 130, especially the angle between the first connecting part 132 and the second connecting part 134. The value of the first lateral spacing w1 and the value of the second lateral spacing w2 is depended on a horizontal extension distance of the intermediate connecting part 136 of the transverse connector 130 and the included angle. For example, the value of first lateral spacing w1 can be varied from 0 cm to 15 cm. In the present embodiment, the included angle is set as 30°, the first lateral spacing w1 is 10 cm, and the second lateral spacing w2 is 5 cm. A person having ordinary skill in the art can adjusting the values of the included angle, the first lateral spacing w1 and the second lateral spacing w2, but not limited in this embodiment.

The backpack 100 also includes a shoulder strap 102 (only a part of which is shown in FIGS. 1A and 1B) connected to the longitudinal supporting element 110, as well as cushioning pads 104 and 106 attached to the longitudinal supporting element 110, providing a cushioning effect of gravity compression caused by the backpack 100 on the back and waist, respectively. One or both of the cushioning pads 104 and 106 can be replaced a fabric that wrapping the longitudinal supporting element 110, or can be further wrapped by the fabric.

Figure 2:
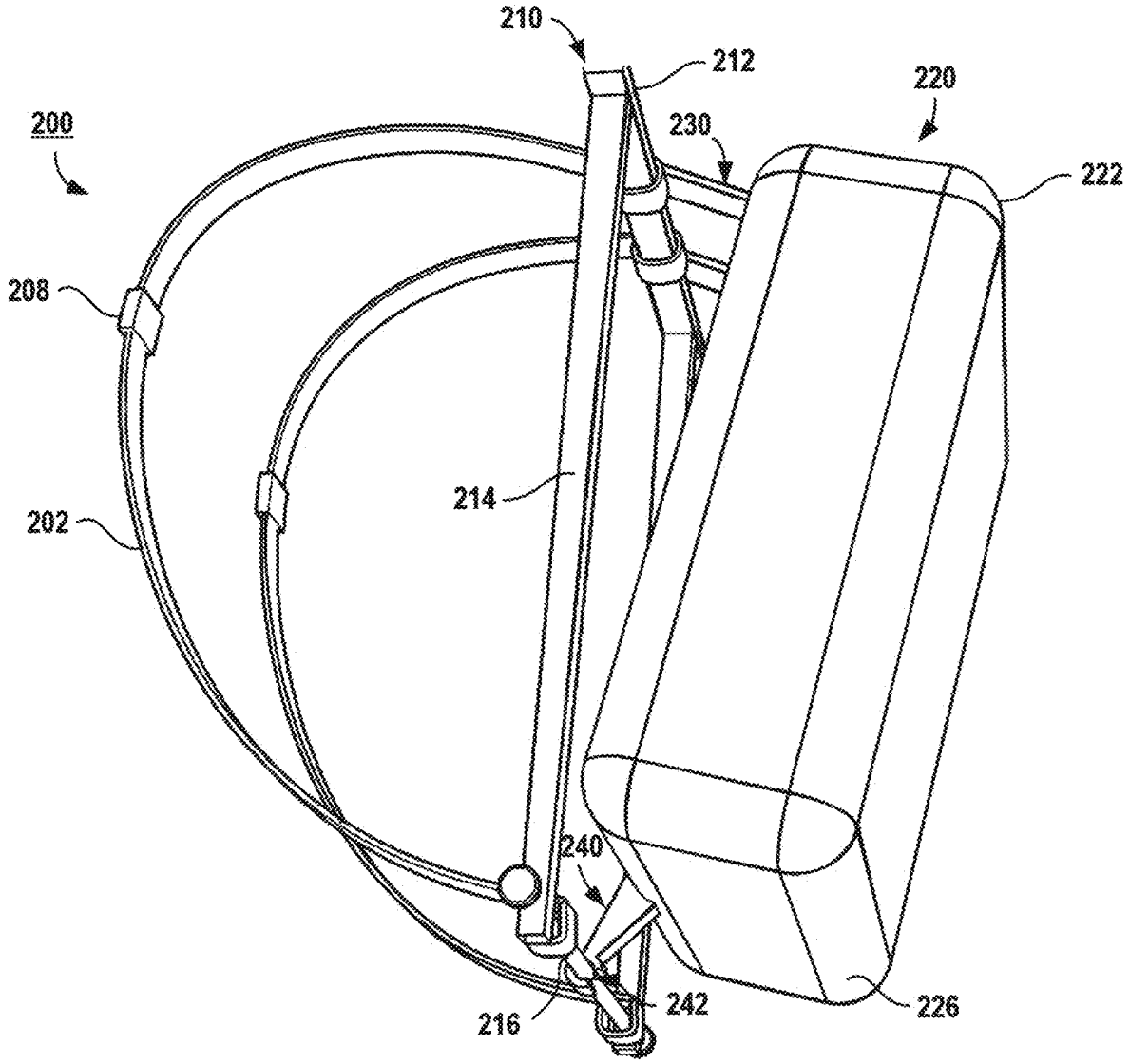
FIG. 2 is a skeleton structure diagram of a backpack of a second embodiment of the present disclosure.

FIG. 2 is a skeleton structure diagram of a backpack 200 of a second embodiment of the present disclosure. The backpack 200 includes a longitudinal supporting element 210, a main body 220 and a transverse connector 230. The backpack 200 also includes a pair of straps 202, each strap 202 includes an adjusting member 208, the adjusting member 208 is configured to adjust the length of the corresponding strap 202, and the structure of the strap 202 is well-known in this art and will not be further elaborated. The longitudinal supporting element 210 includes a first end 212 and a second end 216, and an intermediate portion 214 is connected the first end 212 to the second end 216. Actually, the longitudinal supporting element 210 is wrapped by fabric, and/or attached with buffer pad. the main body 220 includes a top end 222 and a bottom end 226, the main body 220 is inclined to the longitudinal supporting element 210. In this embodiment, the transverse connector 230 can be arranged in pairs and can be composed of hard materials. And the transverse connector 230 can be detachably connected to the longitudinal supporting element 210 or the main body 200.

In the present embodiment, the backpack 200 also includes a supporting component 240 independent of the transverse connector 230. The supporting component 240 is extended by an second end 216 of the longitudinal supporting element 210 (such as the middle part of the longitudinal supporting element 210), and at least partially supporting the weight of the main body 200. The supporting component 240 is made by hard materials, and the hard materials are flexible. The supporting component 240 includes a notch 242, and it is possible to detach the second end 216 under an external force through the elastic deformation of the hard materials, achieving a detachable connection between the main body 220 and the longitudinal supporting element 210. When the transverse connector 230 can also be detachably connected to the longitudinal supporting element 210 or the main body 200, the main body 220 can be separated from the longitudinal supporting element 210 as a whole and can be replaced or cleaned. In this embodiment, the supporting component 240 can be arranged to be non rotatably connected relative to the second end 216.

Figure 3:
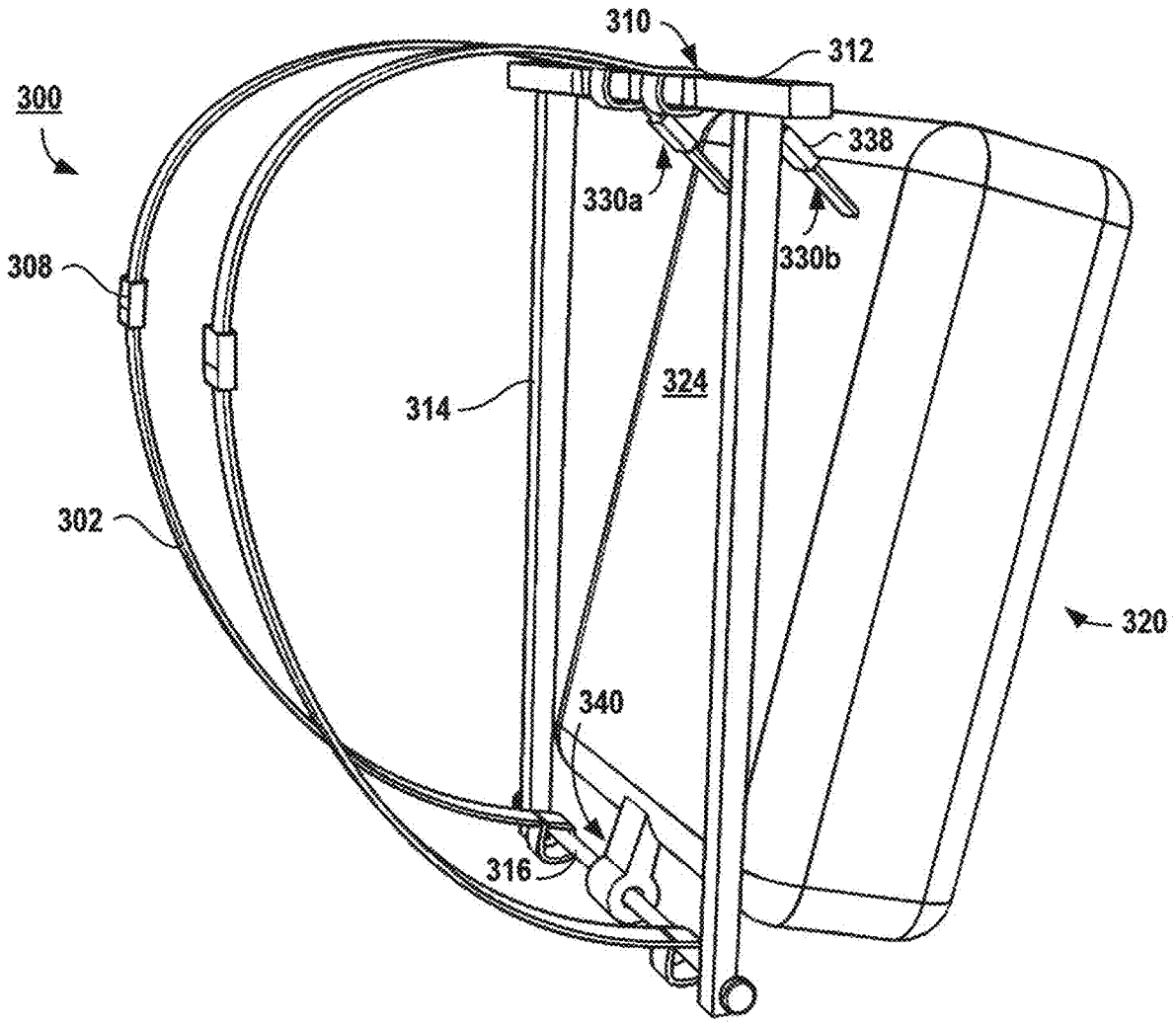
FIG. 3 is a skeleton structure diagram of a backpack of a third embodiment of the present disclosure.

FIG. 3 is a skeleton structure diagram of a backpack 300 of a third embodiment of the present disclosure. The backpack 300 has similar structure with that of backpack 200, but the transverse connector 330 and the supporting component 340 are different with that of backpack 200. Specifically, the transverse connector 330 connects a first end 312 of the longitudinal supporting element 210 and a middle part 324 of the main body 300, and a length of the transverse connector 330 is adjustable. The length is adjusted by a adjusting member 338, the adjusting member 338 can be any form of the existed length adjusting member. In the present embodiment, the adjusting member 338 may be an adjusting latch that is the same as the adjusting member 308 of the strap 302. the adjusting member 338 is made by hard materials, to prevent the main body 320 from swinging freely horizontally.

The supporting component 340 is connected to the second end 316 of the longitudinal supporting element 310, and the second end 316 is connected to the support component 340, allowing the supporting component 340 to rotate around the second end 316. A tightness between the supporting component 340 and the second end 316 can be reasonably set so that the supporting component 340 can only rotate around the second end 316 under an external force. This can be achieved by reasonably setting a diameter of the second end 316 and a diameter of the through-hole corresponding to the support member 340. When the supporting component 340 can rotate around the second end 316 (i.e. the included angle between the supporting component 340 and the longitudinal supporting member changes), the inclined angle of the main body 320 relative to the longitudinal supporting element 310 changes accordingly. Correspondingly, the length of the transverse connector 330 can be adjusted to adapt to changes of the included angle.

Figure 4:
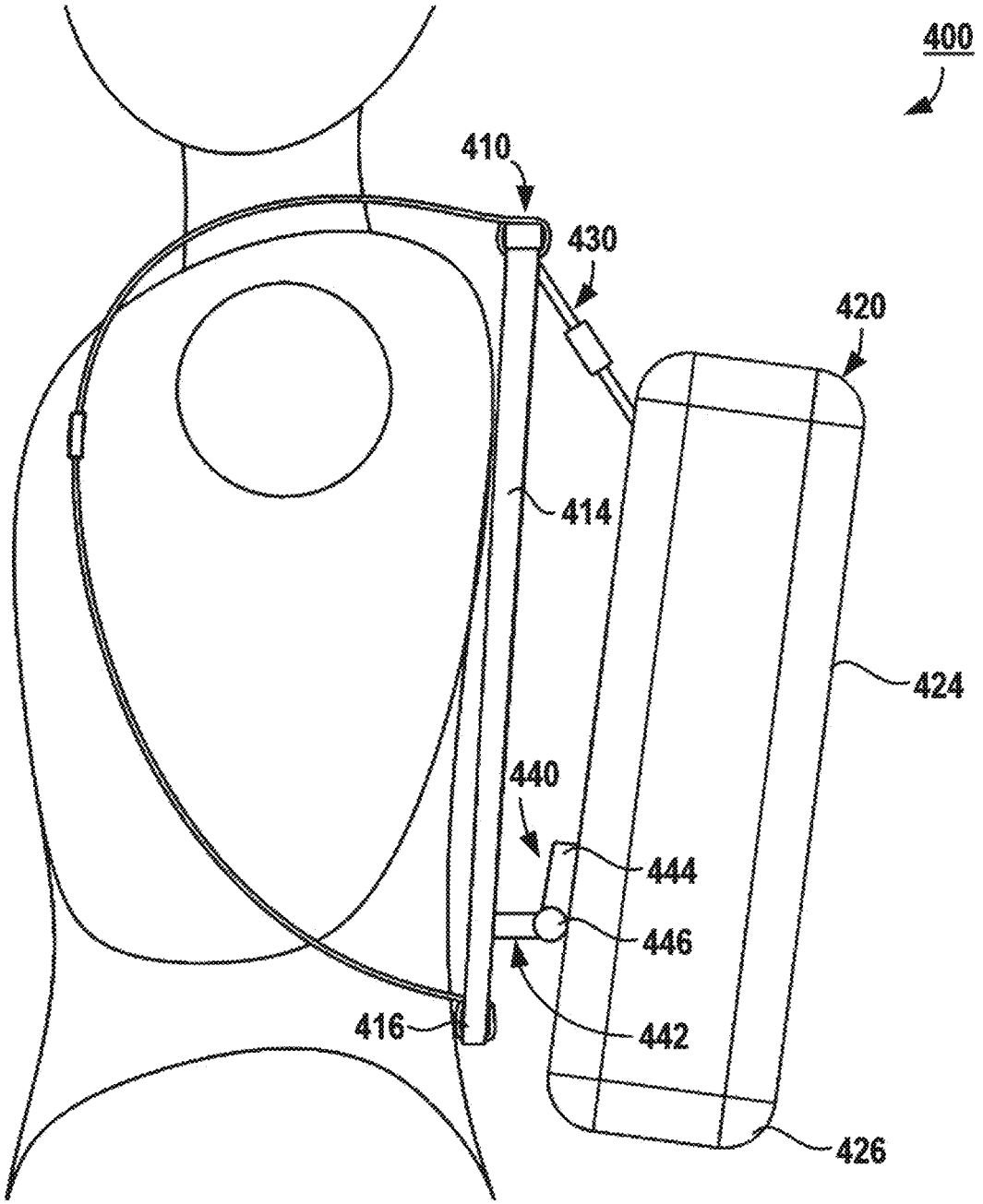
FIG. 4 is a skeleton structure diagram of a backpack of a fourth embodiment of the present disclosure.

FIG. 4 is a skeleton structure diagram of a backpack 400 of a fourth embodiment of the present disclosure. The backpack 400 includes a longitudinal supporting element 410, a main body 420 and a transverse connector 430, and a length of the transverse connector 430 is adjustable. A supporting component 440 is provided between a middle portion 414 of the longitudinal supporting element 410 and a middle portion 424 of the main body 420. The supporting component 440 includes a first extending portion 442 which is connected with the longitudinal supporting element 410, a and a second extending portion 444 which is connected with the main body 420, and a rotating shaft 446 which is connected with the first extending portion 442 and the second extending portion 444, thus making a relative rotation between the first extending portion 442 and the second extending portion 444.

The first extending portion 442 is extended to a first distance through the longitudinal supporting element 410, and forming a first transverse length of the first extending portion 442. The first transverse length allows the bottom end 426 of the main body 420 to be separated from the user's buttocks without contacting when the longitudinal length of the main body 420 is large and easily touching the user's buttocks (such as in hiking or mountaineering backpack scenarios), in order to improve the user's comfort. In this embodiment, the extension distance of the first extending portion 442 increases the second lateral distance between the second end 416 of the longitudinal supporting element 410 and the bottom end 426 of the main body 420, but the main body 420 still maintains a tilt relative to the longitudinal supporting element 410. For example, the extension distance of the first extending portion 442 can be 10 cm to 30 cm, or larger, or smaller, which can be reasonably determined based on the longitudinal length of the main body 420.

Figure 5:
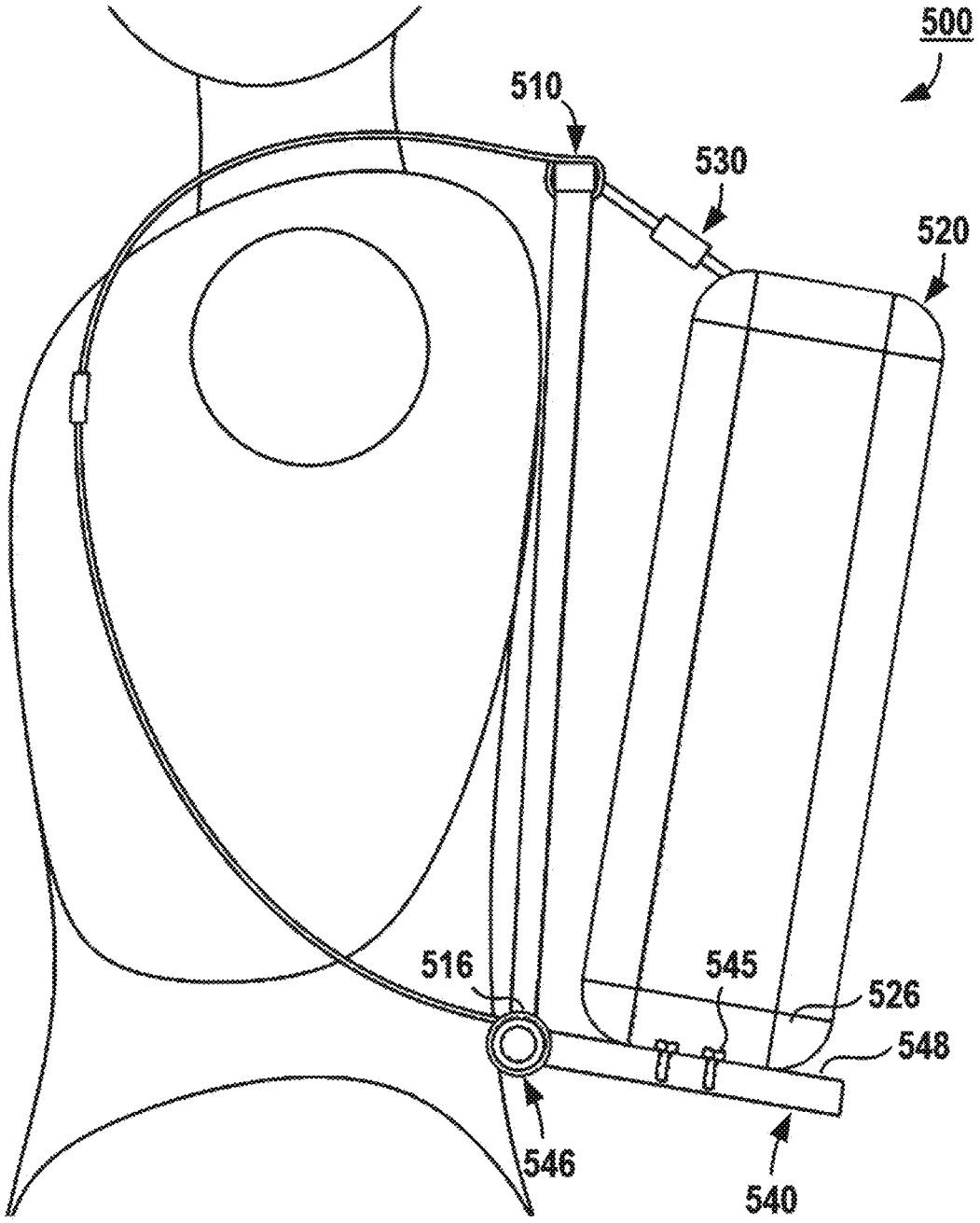
FIG. 5 is a skeleton structure diagram of a backpack of a fifth embodiment of the present disclosure.

FIG. 5 is a skeleton structure diagram of a backpack 500 of a fifth embodiment of the present disclosure. The backpack 500 includes a longitudinal supporting element 510, a main body 520, and a transverse connector 530 and a supporting component 540, and a length of the transverse connector 530 is adjustable. The supporting component 540 is provided on a second end 516 of the longitudinal supporting element 510, and is extended horizontally forms a supporting platform 548. In the present embodiment, the supporting platform 548 may be a plate, and a whole bottom end 526 of the supporting platform 548 supports the main body 520. The main body 520 and the supporting platform 548 are fixed connection or detached connection, through one fixed member 545 or a plurality of fixed members 545.

The supporting platform 548 is able to rotate around the second end 516, to allow the inclined angle of the main body 520 and the longitudinal supporting element 510 to be adjusted. In the present embodiment, the inclined angle between the supporting platform 548 and the longitudinal supporting element 510 is larger than 90°, so the main body 520 is always tilted towards the right side as shown in the FIG. 5. The supporting component 540 also includes a fastener 546 (such as a fastening bolt) that can fix the inclined angle between the supporting platform 548 and the longitudinal supporting element 510. After determining an appropriate angle value, the inclined angle between the supporting platform 548 and the longitudinal supporting element 510 is fixed by tightening the fastener 546. When adjusting the inclined angle between the supporting platform 548 and the longitudinal supporting element 510, loosen the fastener 546 and rotate the supporting platform 548 to adjust the inclined angle between the supporting platform 548 and the longitudinal supporting element 510.

Figure 6A:
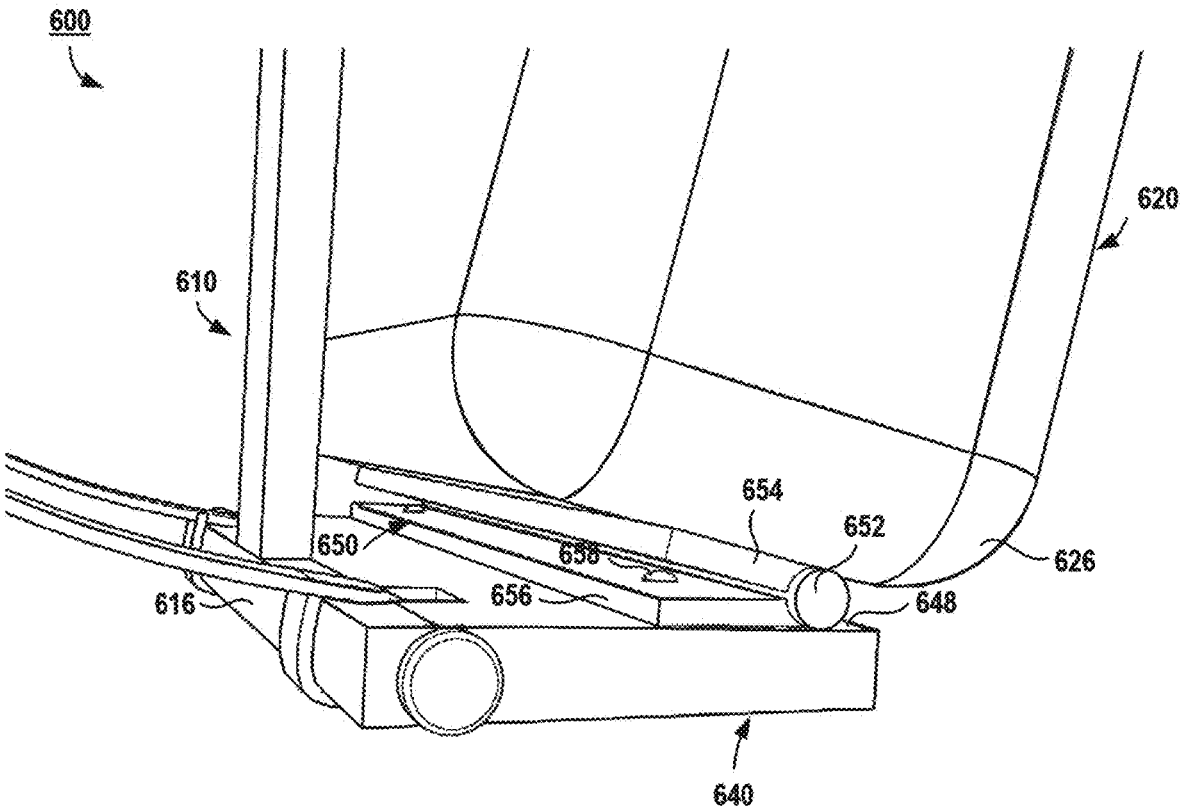
FIG. 6A is a partial perspective view of a supporting component of a backpack of a sixth embodiment of the present disclosure.
Figure 6B:
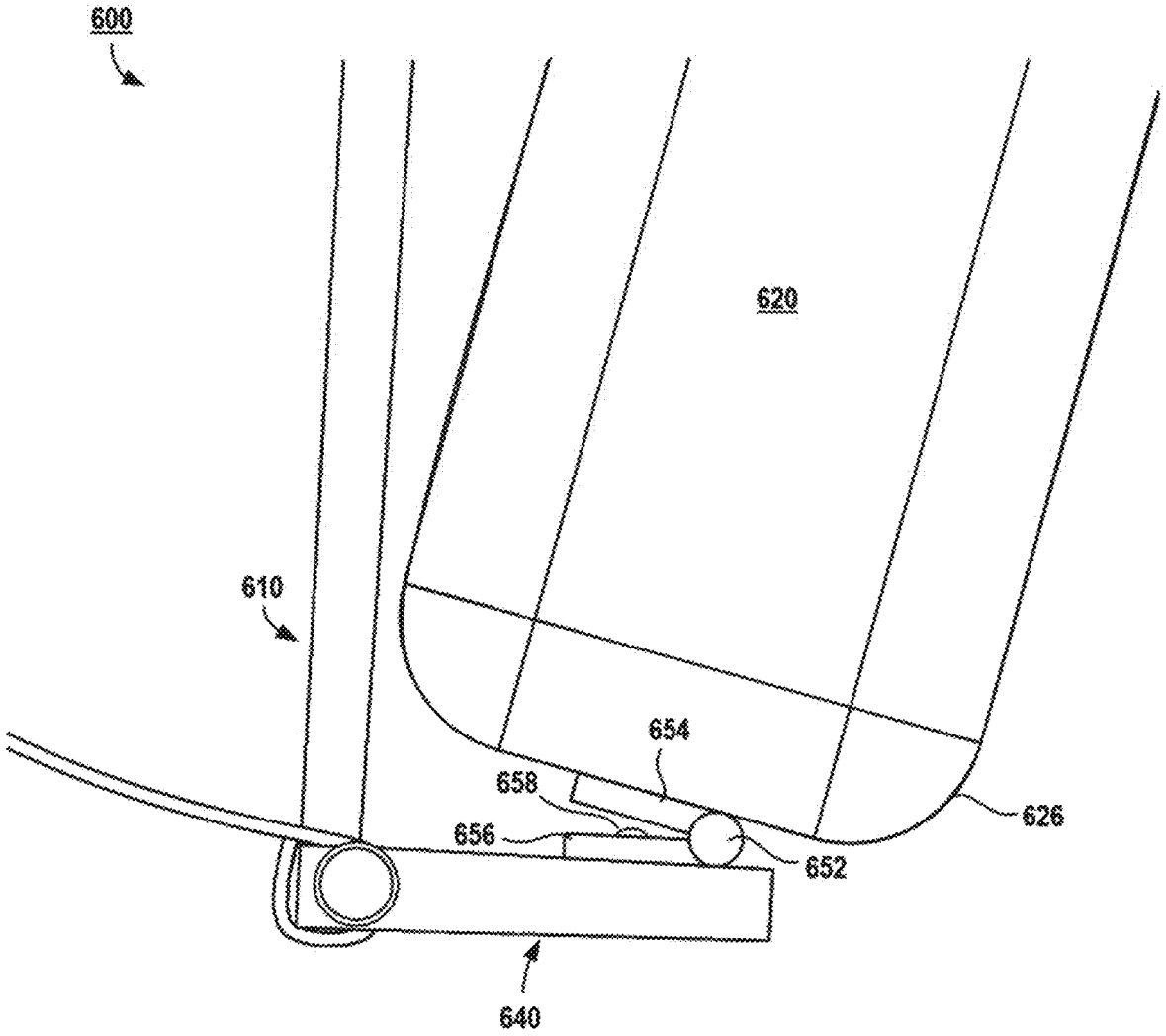
FIG. 6B is a side view of the supporting component of the backpack of the sixth embodiment of the present disclosure.

FIGS. 6A and 6B show an alternative technology solution of the supporting component 540 as shown in the embodiment of FIG. 5, and FIG. 6A is a partial perspective view and FIG. 6B is a side view. What is different from the supporting component 540, the supporting component 640 is fixedly connected to the second end 616 of the longitudinal supporting element 610 and cannot rotate around the longitudinal supporting element 610. The supporting component 640 forms a support platform 648, and the support main body 620. In this embodiment, the main body 620 is provided on the support platform 648 through a first intermediate connector 650. The first intermediate connector 650 includes a first part 654 connected to the bottom end 626 of the main body 620 and a second part 656 connected to the supporting platform 648. The inclined angle between the first part 654 and the second part 656 can be changed with the rotation of a rotating shaft 652. In this embodiment, a first intermediate connector 650 is provided with at least one protrusion 658. And the protrusion 658 is located between the first part 654 and the second part 656, to separate the first part 654 and the second part 656, so that the main body 620 remains inclined relative to the longitudinal supporting element 610. In this embodiment, the protrusion 658 is displayed on the second part 656, but those skilled in the art may be aware that the protrusion 658 can also be set on the first part 654 and have the same effect.

Figure 7A:
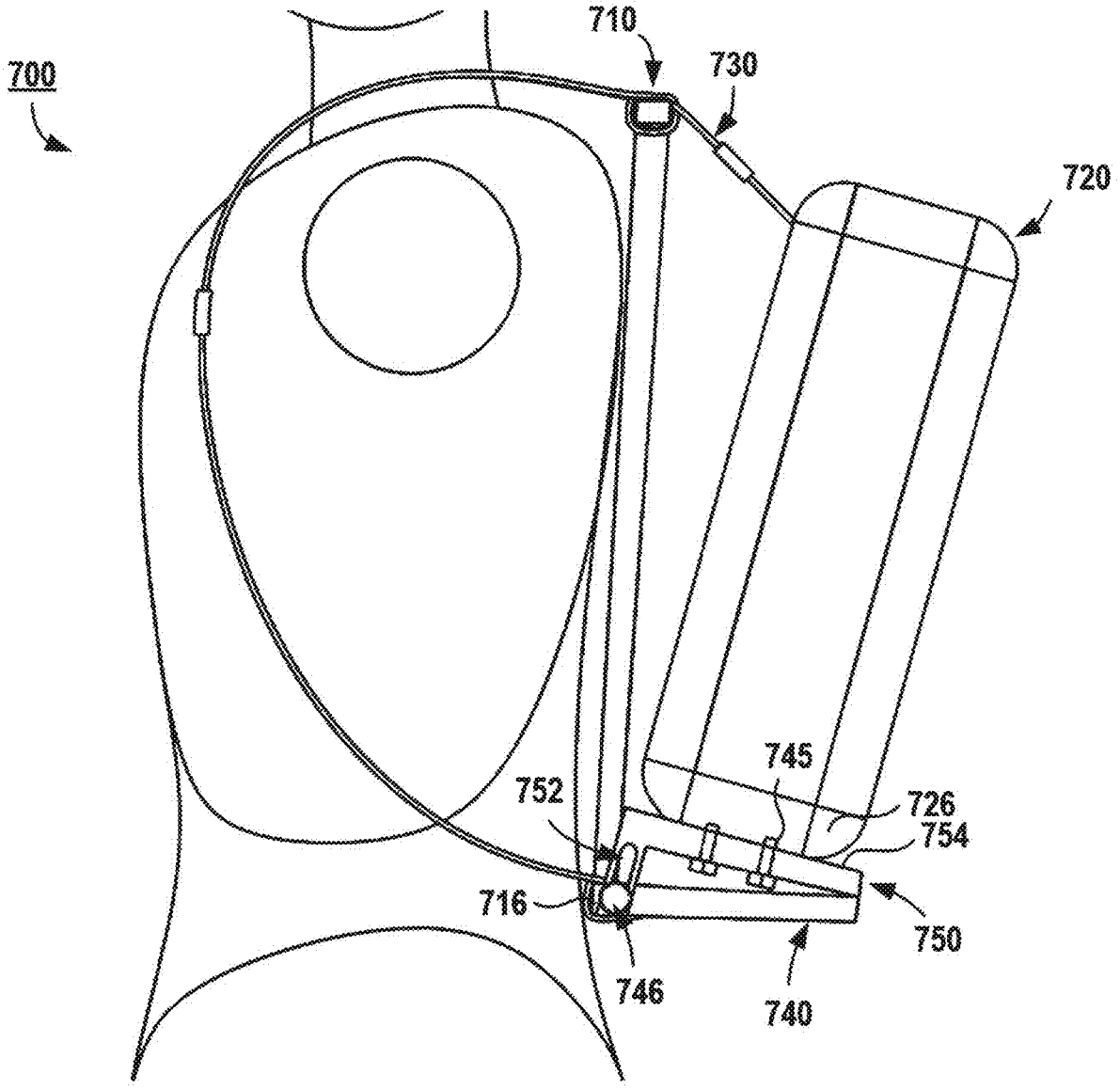
FIG. 7A is a side view of a backpack of a seventh embodiment of the present disclosure.
Figure 7B:
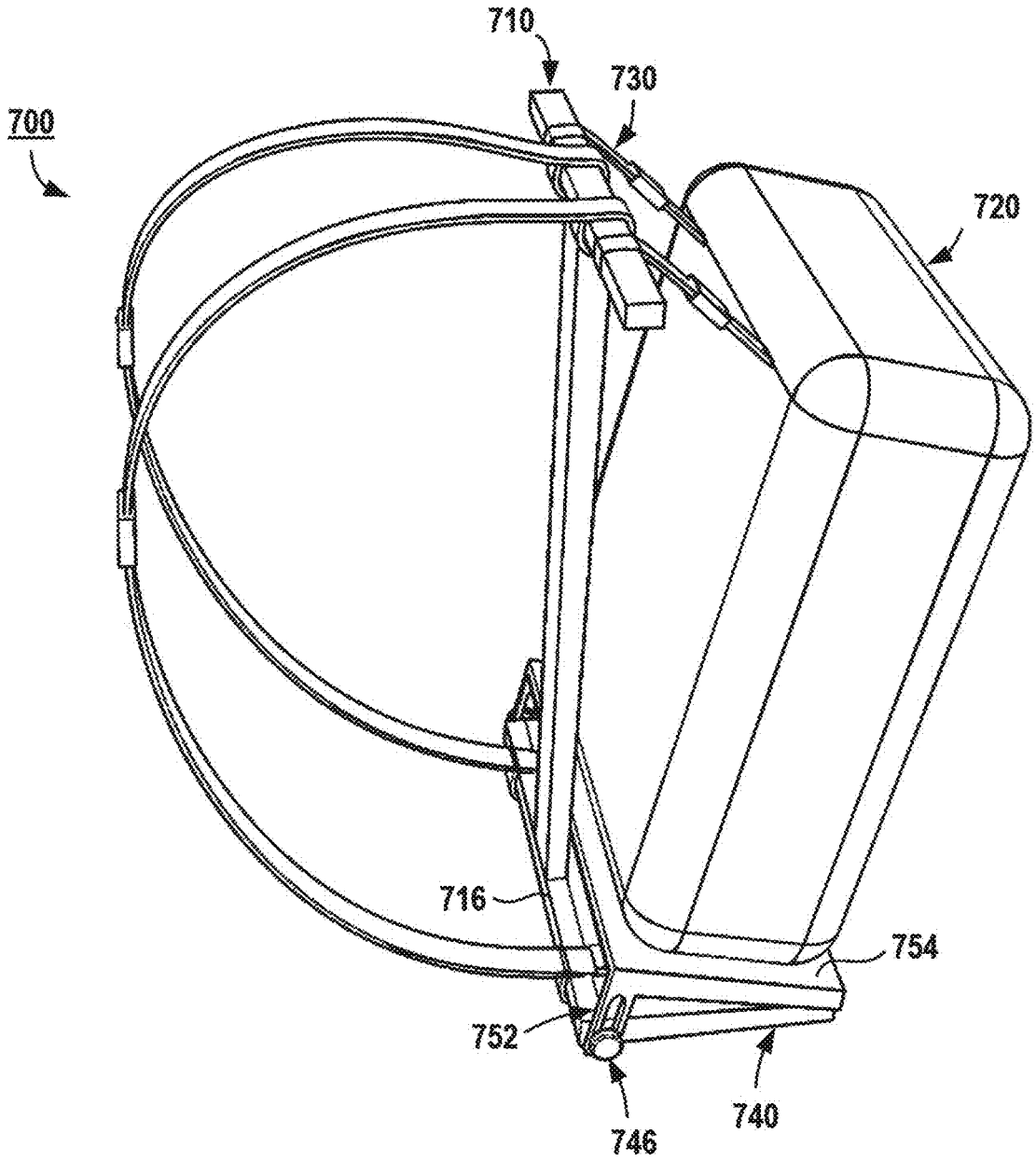
FIG. 7B is a perspective view of the backpack of the seventh embodiment of the present disclosure.

FIG. 7A and FIG. 7B is a side view and a perspective view of a backpack 700 of the seventh embodiment of the present disclosure, respectively. The backpack 700 includes a longitudinal supporting element 710, a main body 720, and a transverse connector 730 and a supporting component 740, and a length of the transverse connector 730 is adjustable. The backpack 700 also includes a supporting component 740, the supporting component 740 is connected with the second end 716 of the longitudinal supporting element 710, and can not rotate around the longitudinal supporting element 710. The main body 720 is provided on the supporting component 740 through the first intermediate connector 750. In the present embodiment, the first intermediate connector 750 is in a wedge shape with an oblique surface 754 touching the bottom end 726 of the main body 720. The main body and the oblique surface 754 are fixed connection or detached connection through one fixed member 745 or a plurality of fixed members 745.

A sliding groove 752 is defined on the first intermediate connector 750, and a fastener 746 is arranged in the sliding groove 752. The sliding groove 752 can move along the fastener 746, thus adjusting the inclined angle of the inclined plane 754. Therefore, the inclination angle between the main body 720 and the longitudinal support 710 can change. After determining the appropriate inclined angle, fixing the angle between the inclined surface 754 and the longitudinal supporting element 710 by tightening the fastener 746. When adjusting the inclined angle, loosen fastener 746 to adjust the angle between the inclined surface 754 and the longitudinal supporting element 710.

Figure 8:
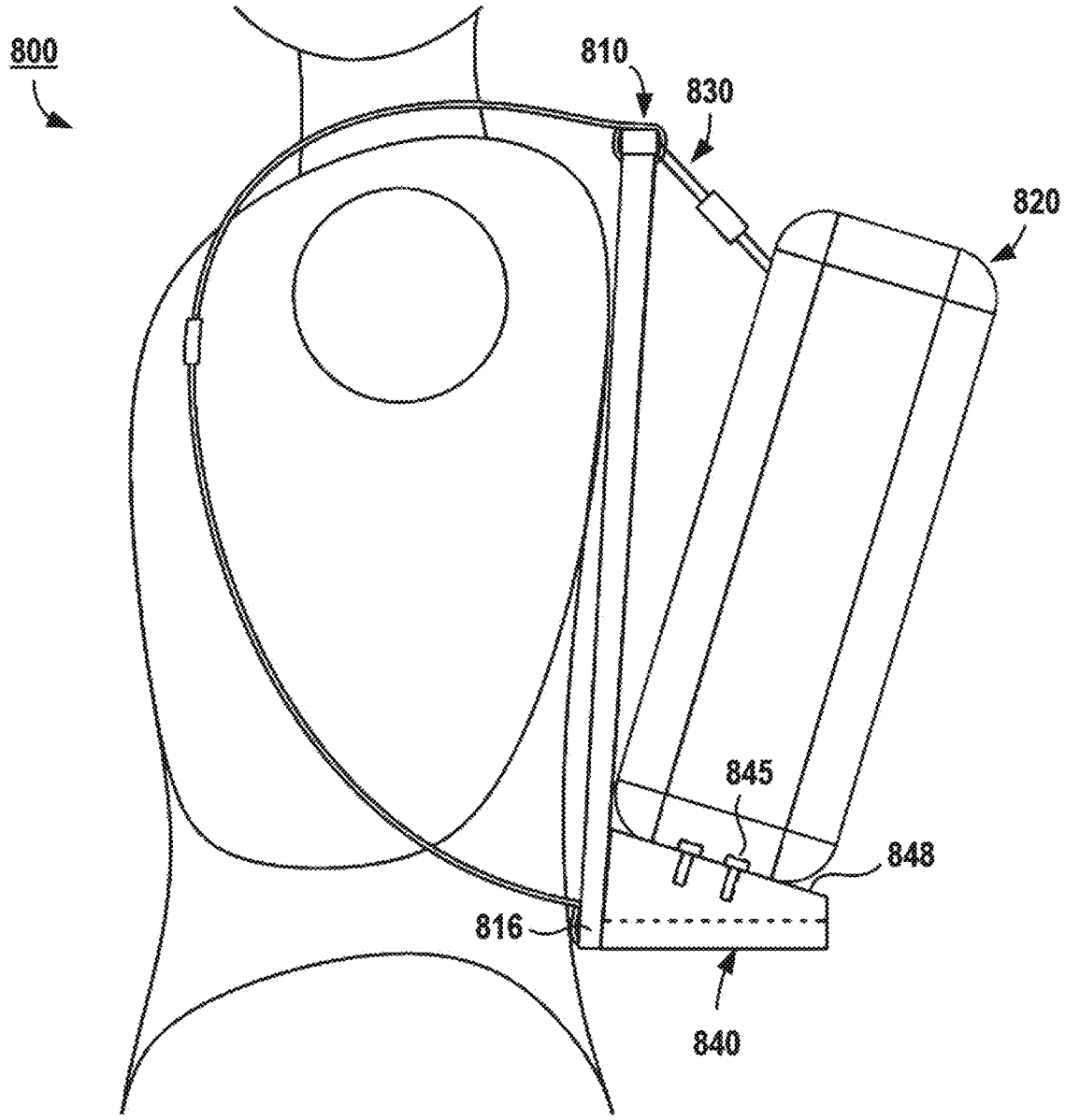
FIG. 8 is a skeleton structure diagram of a backpack of an eighth embodiment of the present disclosure.

FIG. 8 is a skeleton structure diagram of a backpack 800 of an eighth embodiment of the present disclosure. The backpack 800 comprising a longitudinal supporting element 810, a main body 820, and a transverse connector 830, and a supporting component 840. The supporting component 840 is connected with a second end 816 of the longitudinal supporting element 810, and is wedge shaped. The inclined surface 848 supports the main body 820, and the main body 820 and the inclined surface 848 are fixed connection or detached connection through a fastener 845. In this embodiment, the inclined angle of the main body 820 relative to the longitudinal supporting element 810 are fixed, and is unadjustable, so the transverse connector 830 is set in a fixed length.

Figure 9:
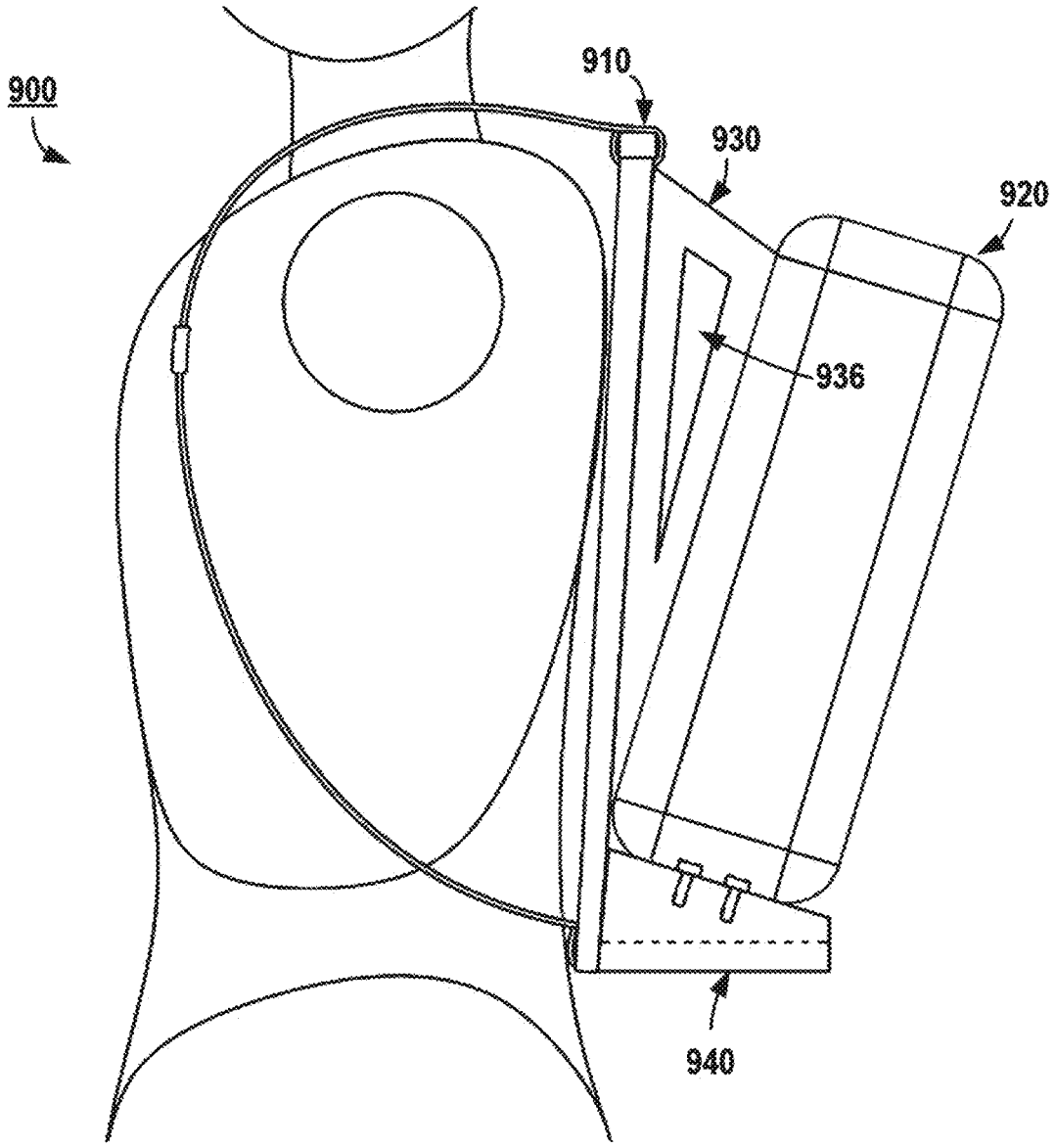
FIG. 9 is a skeleton structure diagram of a backpack of a nineth embodiment of the present disclosure.

FIG. 9 is a skeleton structure diagram of a backpack 900 of a ninth embodiment of the present disclosure. The backpack 900 includes a longitudinal supporting element 910, a main body 920, and a transverse connector 930, and a supporting component 940. The backpack 900 has similar structure with that of backpack 800 shown in FIG. 8, but a structure of the transverse connector 930 is different with that of backpack 800. In the present embodiment, the transverse connector 930 connects the longitudinal supporting element 910 and main body 920 at a vertical direction, and has a shape that adapts to the space formed between the longitudinal supporting element 910 and main body 920 (shown as an approximate triangle in FIG. 9). The longitudinal supporting element 910 of approximate triangle may not fill the space formed between the longitudinal supporting element 910 and main body 920, and in sheet shape and a number may be multiple.

A through-hole 936 may be defined at the center of the transverse connector 930 to facilitate air circulation. The shape and position of through-hole 936 are not limited to the shape and position shown in FIG. 9, and the through-hole 936 may be replaced by other forms, such as multiple smaller holes distributed on the transverse connector 930. A person having ordinary skill in the art can predict various other possible forms of air circulation. In other embodiments, the through-hole 936 may not exist.

Figure 10:
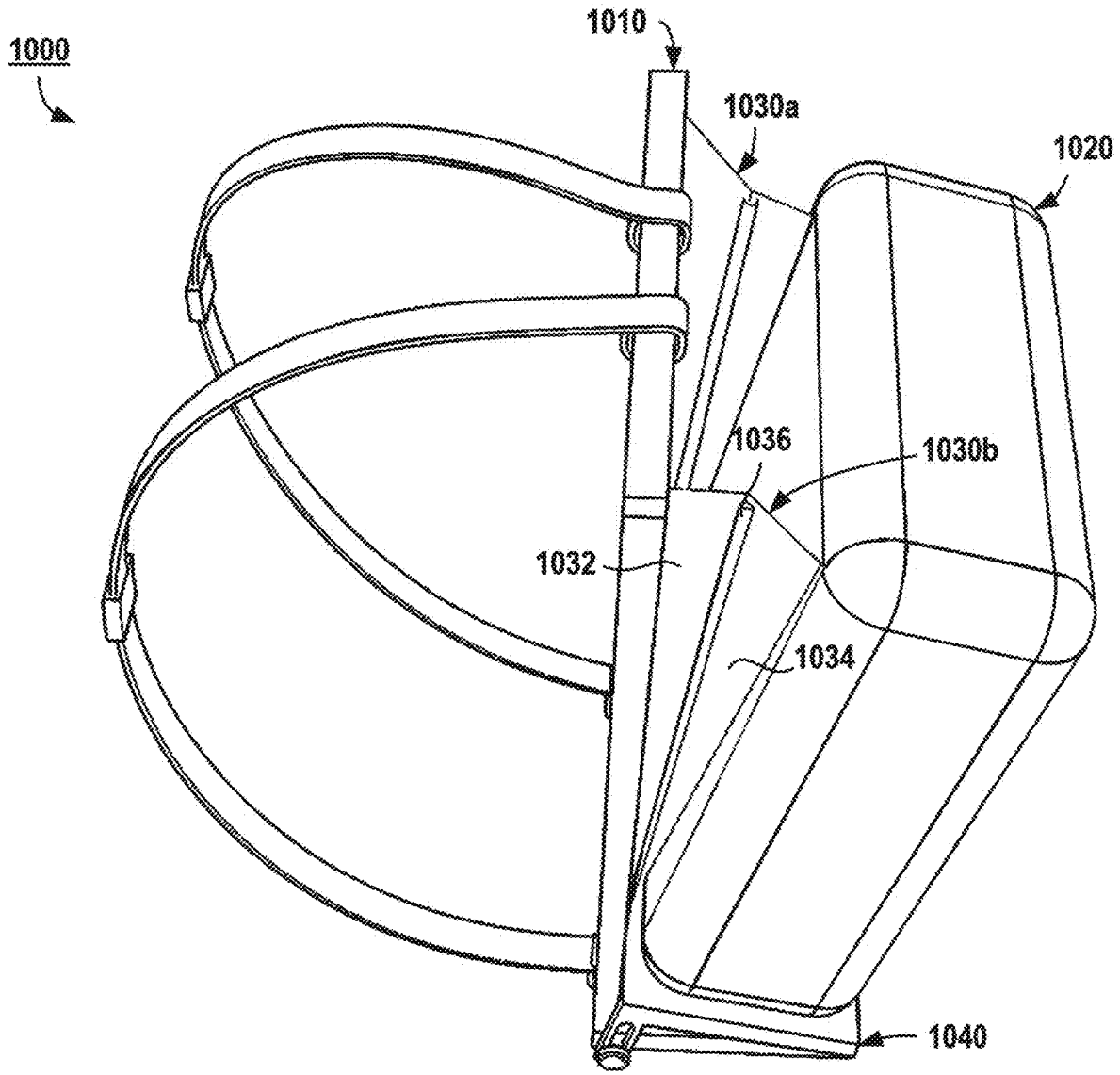
FIG. 10 is a skeleton structure diagram of a backpack of a tehth embodiment of the present disclosure.

FIG. 10 is a skeleton structure diagram of a backpack 1000 of a tenth embodiment of the present disclosure. The backpack 1000 includes a longitudinal supporting element 1010, a main body 1020, and a transverse connector 1030, and a supporting component 1040. The backpack 1000 has similar structure with that of backpack 700 shown in FIG. 7, but a structure of the transverse connector 1030 is different with that of backpack 700. In the present embodiment, the transverse connector 1030 connects the longitudinal supporting element 1010 and main body 1020 at a vertical direction, and has a shape that adapts to the space formed between the longitudinal supporting element 1010 and main body 1020 (shown as an approximate triangle in FIG. 10). The transverse connector 1030 also includes a rotating shaft 1036, the rotating shaft 1036 is configured to connect the first part 1032 and the second part 1034. The first part 1032 and the second part 1034 both can rotate around the rotating shaft 1036, thus adjusting a horizontal width of the transverse connector 1030.

The transverse connector 1030 may not fill the space formed between the longitudinal supporting element 1010 and main body 1020, and in sheet shape and a number may be multiple. In this embodiment, there are two transverse connectors 1030, a first transverse connector 1030*a* and a second transverse connector 1030*b*, and located near two sides of the main body 1020, respectively. When the inclined angle of the supporting component 1040 relative to the longitudinal supporting member 1010 is adjusted to change the inclined angle of the main body 1020 relative to the longitudinal supporting member 1010, the transverse connector 1030 adaptively changes its transverse length through the rotation of the first part 1032 and the second part 1034 relative to the rotating shaft 1036.

The rotation of the first part 1032 and the second part 1034 relative to the rotating shaft 1036 can be occurred under an external force action only, therefore, the main body 1020 cannot swing freely in the horizontal direction. Actually, the specific form of horizontal connector 1030 can be a hinge or gemel.

Figure 11:
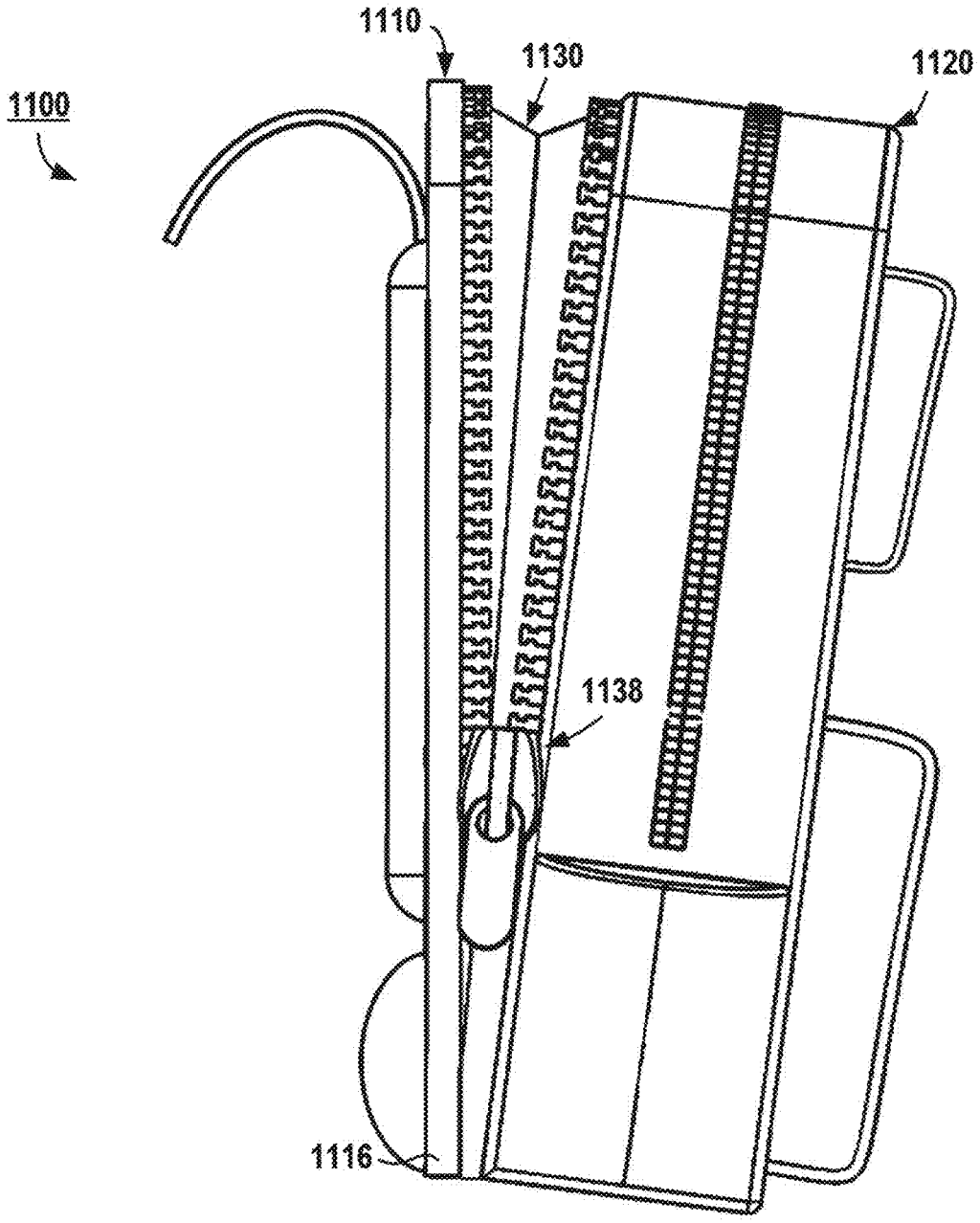
FIG. 11 is a skeleton structure diagram of a backpack of an eleventh embodiment of the present disclosure.

FIG. 11 is a skeleton structure diagram of a backpack 1100 of an eleventh embodiment of the present disclosure. The backpack 1100 includes a longitudinal supporting element 1110, a main body 1120, and a transverse connector 1130. The transverse connector 1130 can be in the form of the transverse connector 1030 or other adjustable lateral width forms (such as elastic connectors). The horizontal connector 1130 is surrounded by a zipper 1138 along the longitudinal supporting element 1110 and the main body 1120. When the zipper 1138 is fully opened, the force of the transverse connector 1130 (such as elastic repulsion) causes the main body 1120 to tilt relative to the longitudinal support member 1110. When the zipper 1138 is fully closed, the force of the transverse connector 1130 is offset by the zipper 1138, causing the main body 1120 to be parallel to the longitudinal supporting member 1110 and closely adhere to the longitudinal supporting member 1110. Therefore, the main body 1120 is in a non tilted position at this time. This design supports convenient switching between tilted and non tilted positions for the main body 1120.

Figure 12:
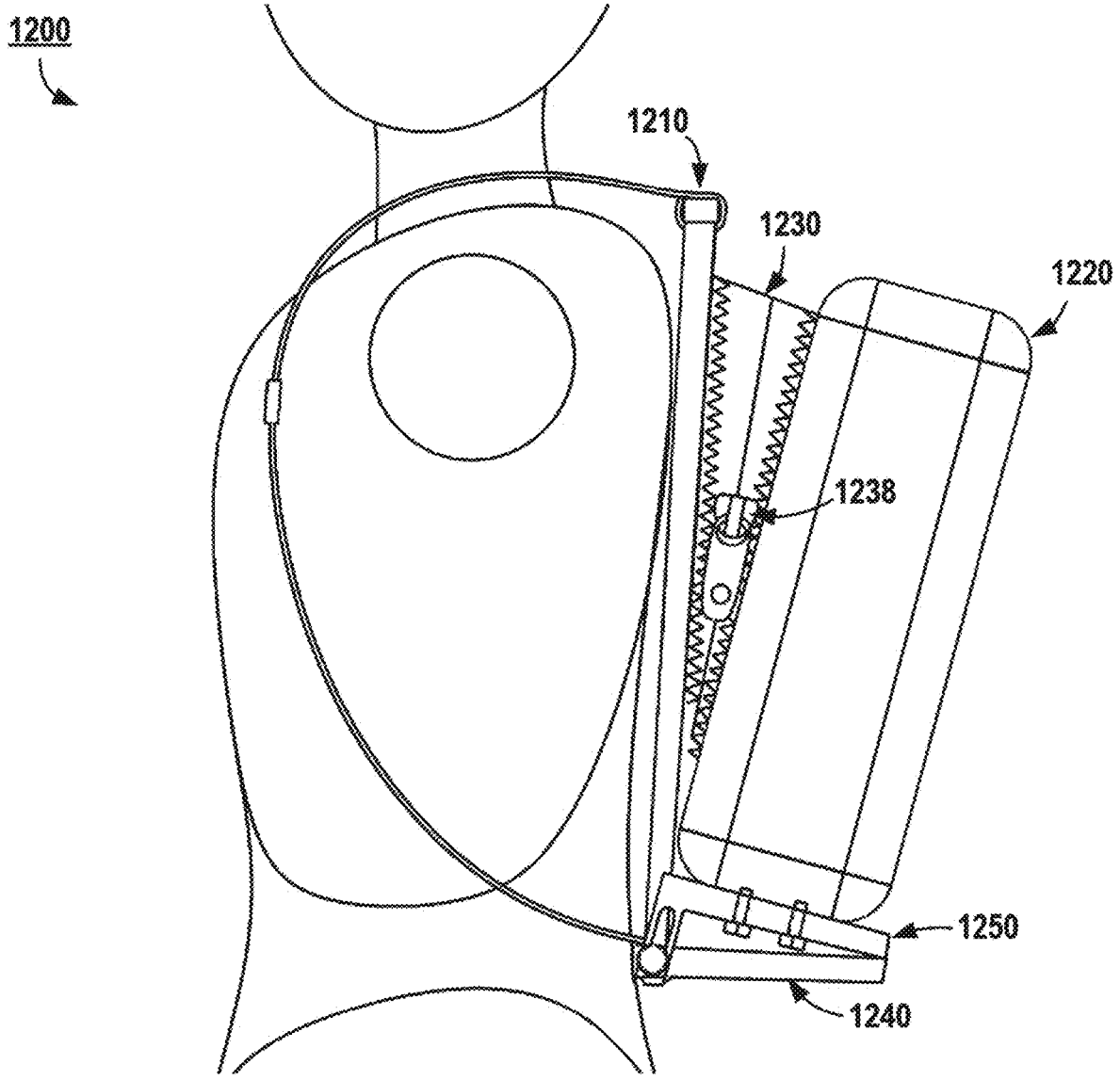
FIG. 12 is a skeleton structure diagram of a backpack of a twelfth embodiment of the present disclosure.

FIG. 12 is a skeleton structure diagram of a backpack 1200 of a twelfth embodiment of the present disclosure. The backpack 1200 includes a longitudinal supporting element 1210, a main body 1220, and a transverse connector 1230, and a supporting component 1240. The backpack 1000 has similar structure with that of backpack 700 shown in FIG. 7, but a structure of the transverse connector 1230 is different with that of backpack 700. In the present embodiment, the transverse connector 1230 connects the longitudinal supporting element 1210 and main body 1220 at a vertical direction, and has a shape that adapts to the space formed between the longitudinal supporting element 1210 and main body 1220 (shown as an approximate triangle in FIG. 12). The width of the transverse connector 1230 can be adjusted horizontally, for example, in the same form as shown in FIG. 10.

In the twelfth embodiment, the transverse connector 1230 is surrounded by a zipper 1238. When the zipper 1238 is fully opened, the supporting component 1240 and the first intermediate connector 1250 lead the main body 1220 is inclined relative to the longitudinal supporting element 1210. When the zipper 1238 is fully closed, the first middle connection member 1250 can be adjusted to parallel to the supporting component 1240, so that the main body 1220 is parallel to the longitudinal supporting element 1210 and closely adheres to the longitudinal supporting element 1210. Therefore, the main body 1220 is in a non inclined position. In this embodiment, the supporting component 1240 and the first intermediate connector 1250 may be exposed to the outside without being wrapped in fabric.

Figure 13:
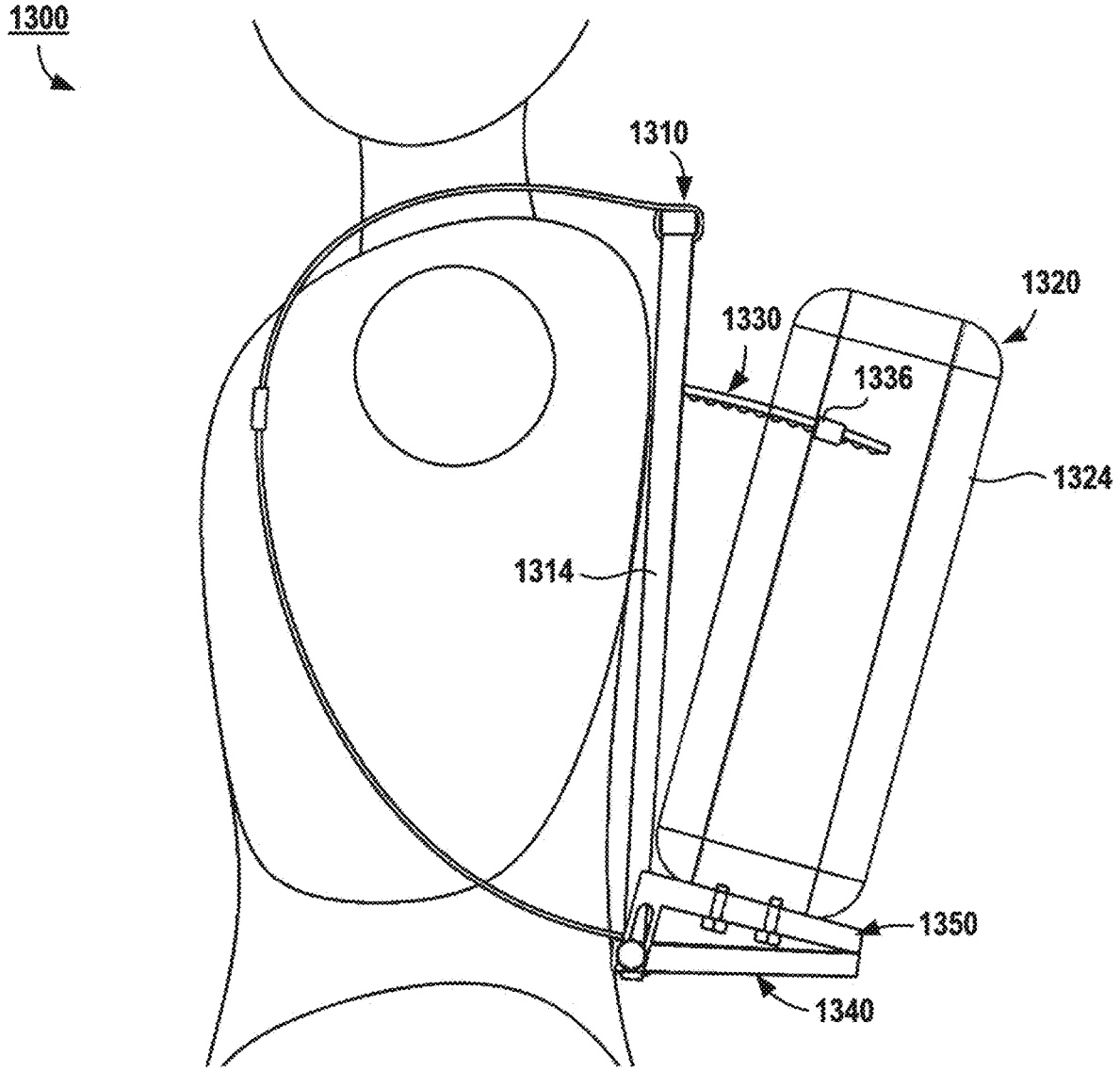
FIG. 13 is a skeleton structure diagram of a backpack of a thirteenth embodiment of the present disclosure.

FIG. 13 is a skeleton structure diagram of a backpack 1300 of a thirteenth embodiment of the present disclosure; the backpack 1300 includes a longitudinal supporting element 1310, a main body 1320, and a transverse connector 1330, and a supporting component 1340. The backpack 1300 has similar structure with that of backpack 700 shown in FIG. 7, but a structure of the transverse connector 1330 is different with that of backpack 700. In the present embodiment, the transverse connector 1330 connects the longitudinal supporting element 1310 and main body 1320. And a with of the transverse connector 1330 can be adjusted at horizontal direction. Specifically, the transverse connector 1330 is a rack and is provided on a fixed portion 1336 of the main body 1320. The transverse connector 1330 can penetrate through the fixed portion 1336 and slide within it, thus enabling the transverse width of the transverse connector 1330 to be adjusted at a fixed distance. Therefore, the inclined angle of the main body 1320 relative to the longitudinal support 1310 can vary at a fixed spacing (such as 5° or 10°). When adjusting the lateral width of the transverse connector 1330, the first intermediate connector 1350 adjusts its slope adaptively in a similar manner as previously described. The material of the lateral connector 1330 can be a rigid material, such as hard plastic or lightweight metal (such as aluminum or aluminum alloy).

Figure 14A:
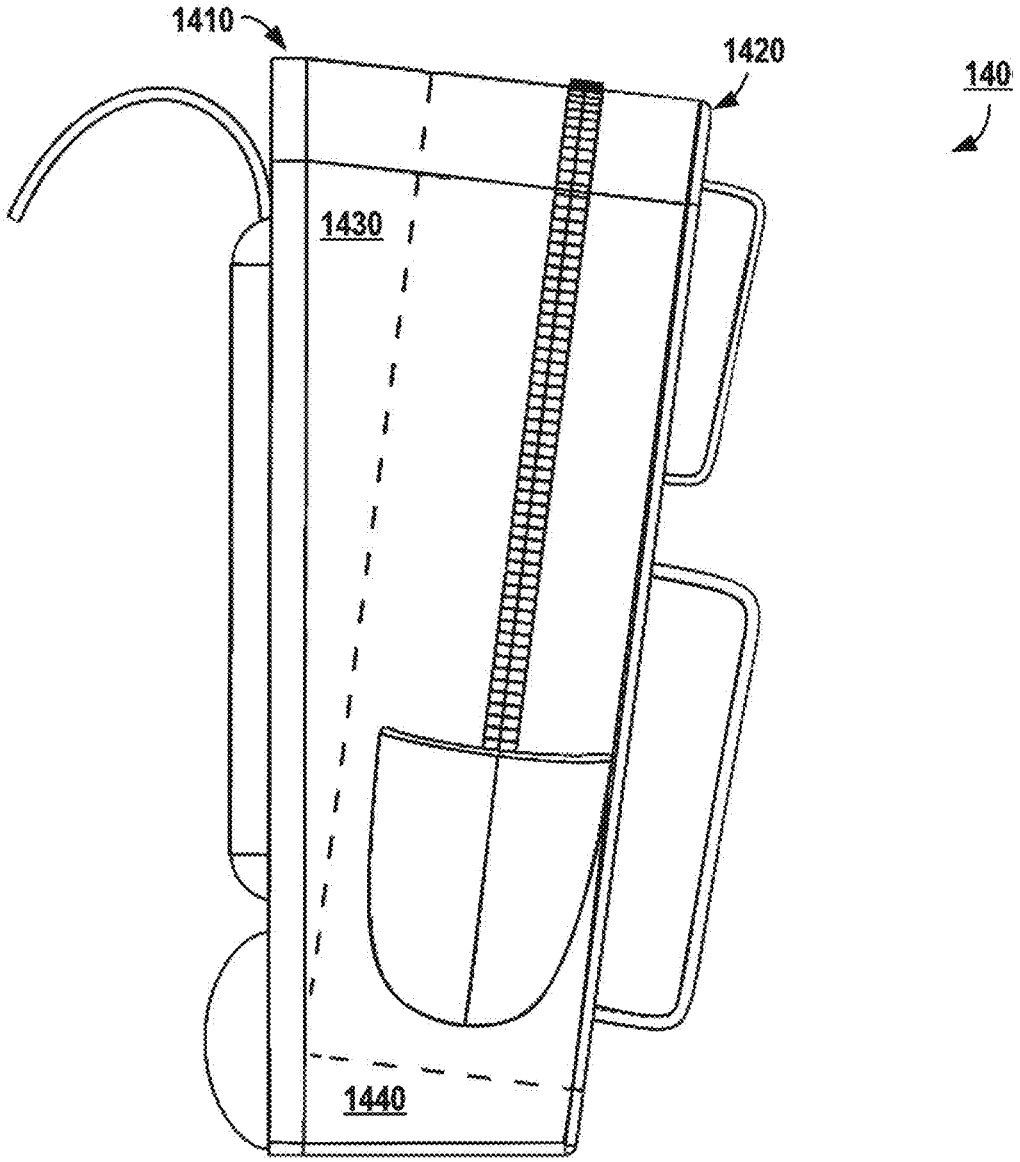
FIG. 14A is a side view of a backpack of a fourteenth embodiment of the present disclosure.
Figure 14B:
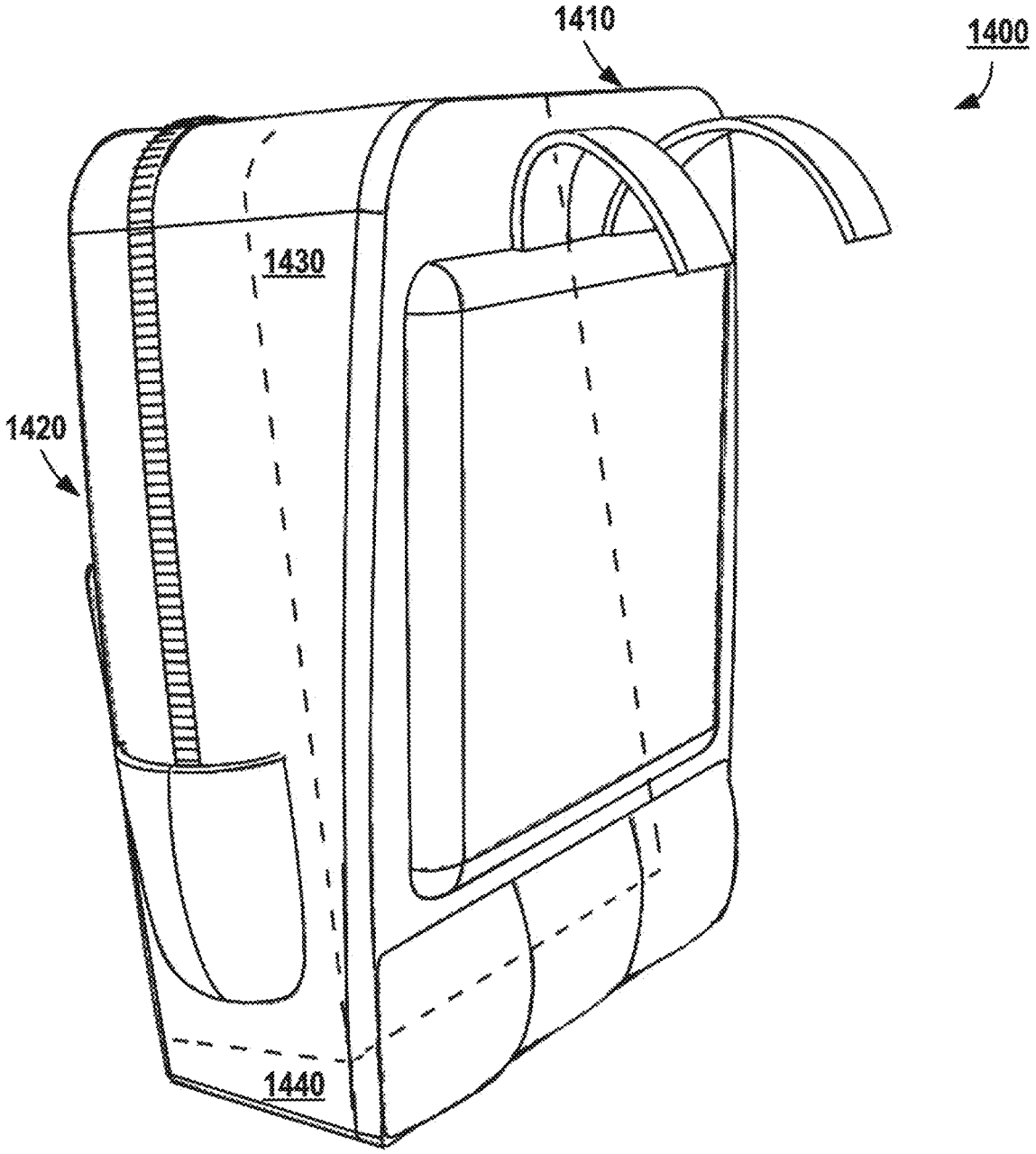
FIG. 14B is a partial perspective view of a backpack of the fourteenth embodiment of the present disclosure.

FIGS. 14A and 14B are a side view and a partial perspective view of a backpack 1400 of a fourteenth embodiment of the present disclosure. The backpack 1400 includes a longitudinal supporting element 1410, a main body 1420 (showing with broken line), and a transverse connector 1430, and a supporting component 1440. The main body 1420 is inclined relative to the longitudinal supporting element 1410. In the fourteenth embodiment, a space between the main body 1420 and the longitudinal supporting element 1410 is wrapped by fabric, and the space is filled with filling materials (such as sponge), to form the transverse connector 1430. Similarly, a space of a bottom of the main body 1420 is filled with filling materials (such as sponge), to form the supporting component 1440. The transverse connector 1430 is shown as a triangular cross-section in the FIG. 14, while the supporting component 1440 is shown as a wedge cross-section, to maintain the main body 1420 is inclined relative to the longitudinal supporting element 1410.

Figure 15A:
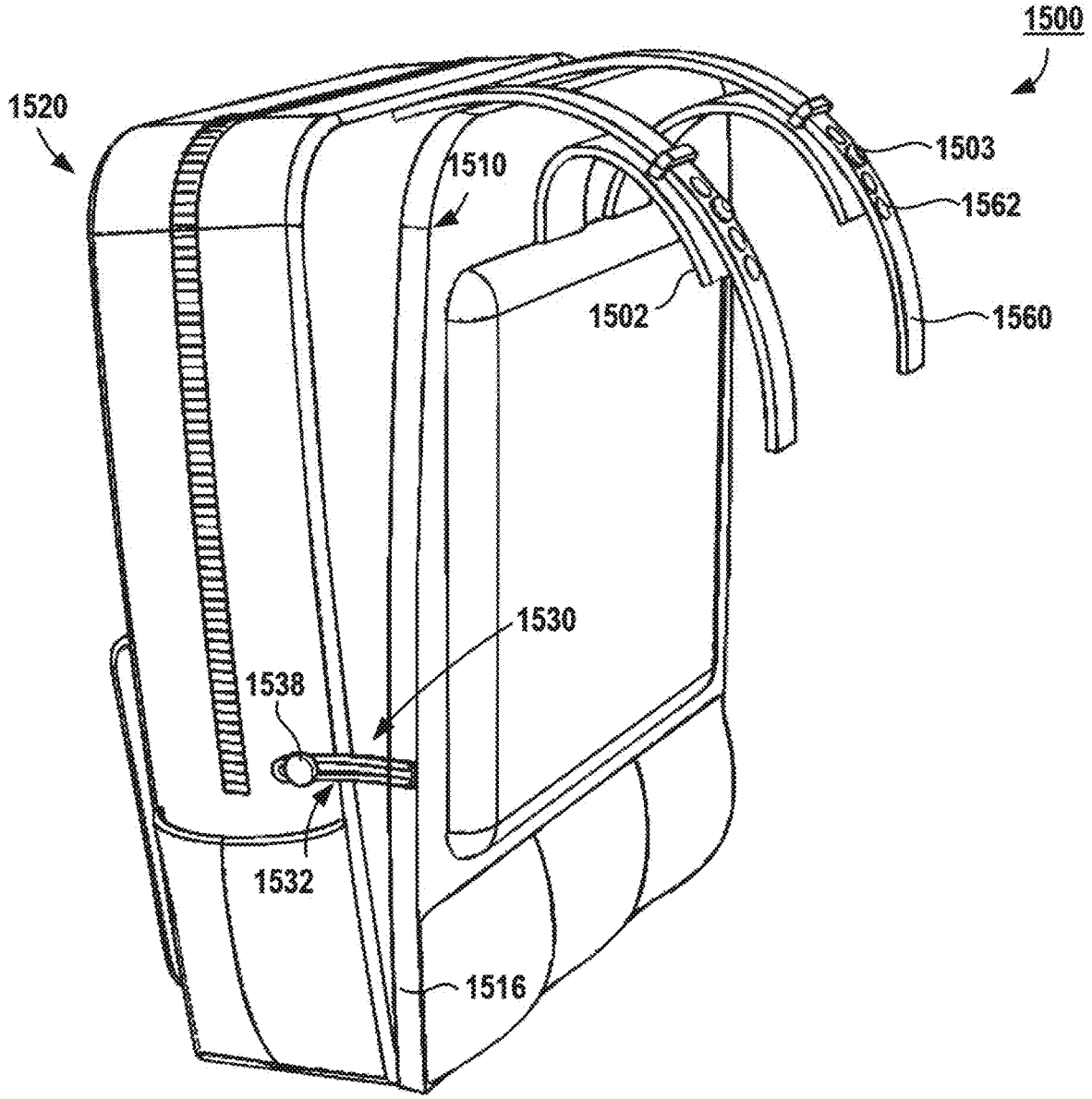
FIG. 15A is a partial perspective view of a backpack of a fifteenth embodiment of the present disclosure.
Figure 15B:
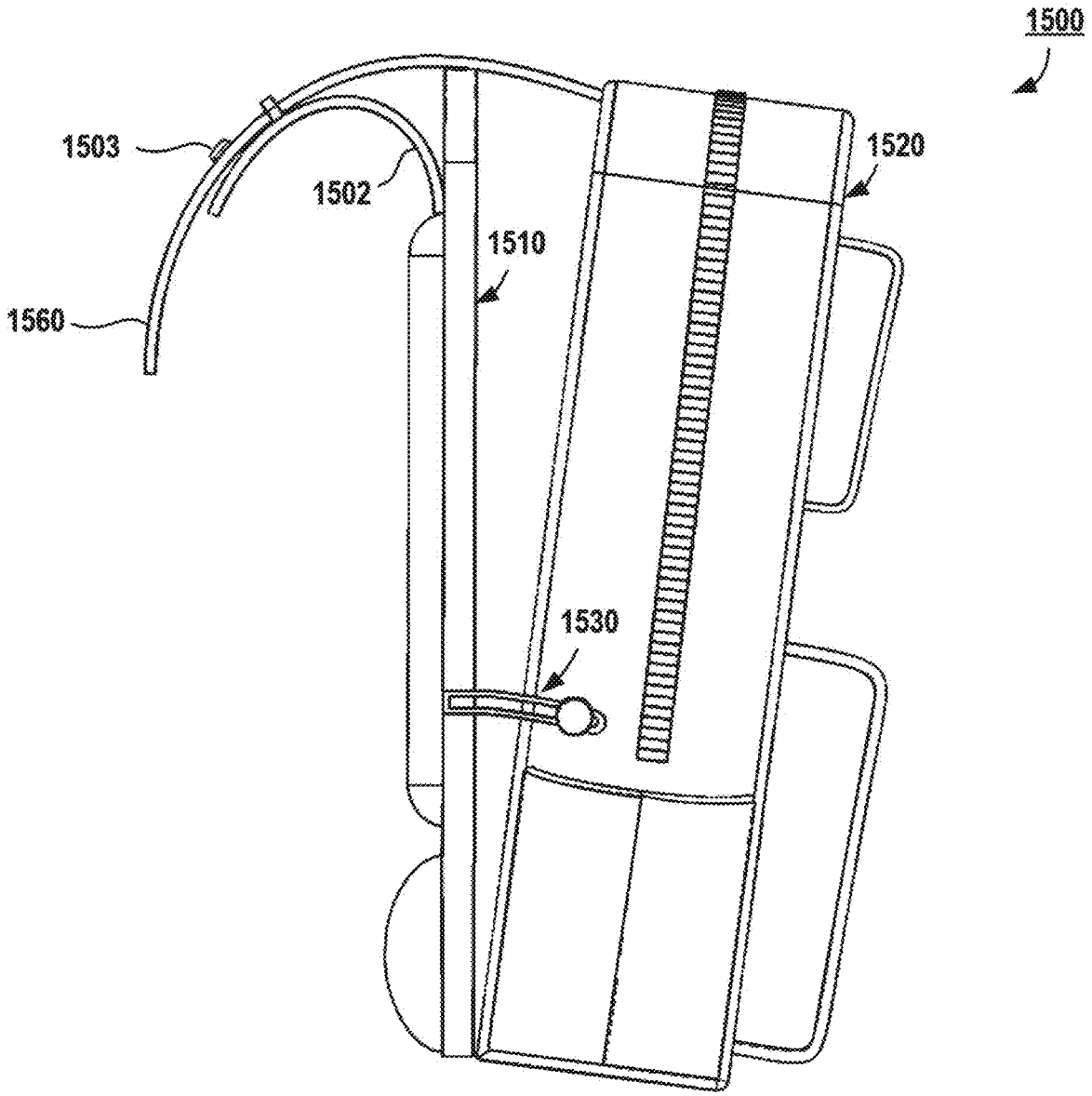
FIG. 15B is a side view of the backpack of the fifteenth embodiment of the present disclosure.

FIG. 15A are a partial perspective view and a side view of a backpack 1500 of a fifteenth embodiment of the present disclosure. The backpack 1500 includes a longitudinal supporting element 1510, a main body 1520, and a transverse connector 1530. The main body 1520 may be sewn onto a second end 1516 of the longitudinal supporting element 1510 using textile thread, and keep inclined relative to the longitudinal supporting element 1510.

The backpack 1500 also includes a pair of straps 1502 and a pair of strips 1560, and the strip 1560 is defined with several interval holes 1562, a fixing bolt 1503 is provided on the strap 1502, the fixing bolt 1503 can pass through the holes 1562 to connect the strip 1560 and the strap 1502 detachably. The holes 1562 allow the strips 1560 to be connected to the strip 1502 at different locations, thereby adapting to the adjustment of the transverse connector 1530. The number of transverse connector 1530 may set as two, located on two sides of the main body 1520, respectively.

A skilled person in this field can expect that the structure of the transverse connector 1530 is not limited to the FIGs. For example, the transverse connector 1530 may be a transverse connector in other embodiments of the present application, such as any transverse connector in the embodiments shown in FIGS. 8-13.

Figure 16A:
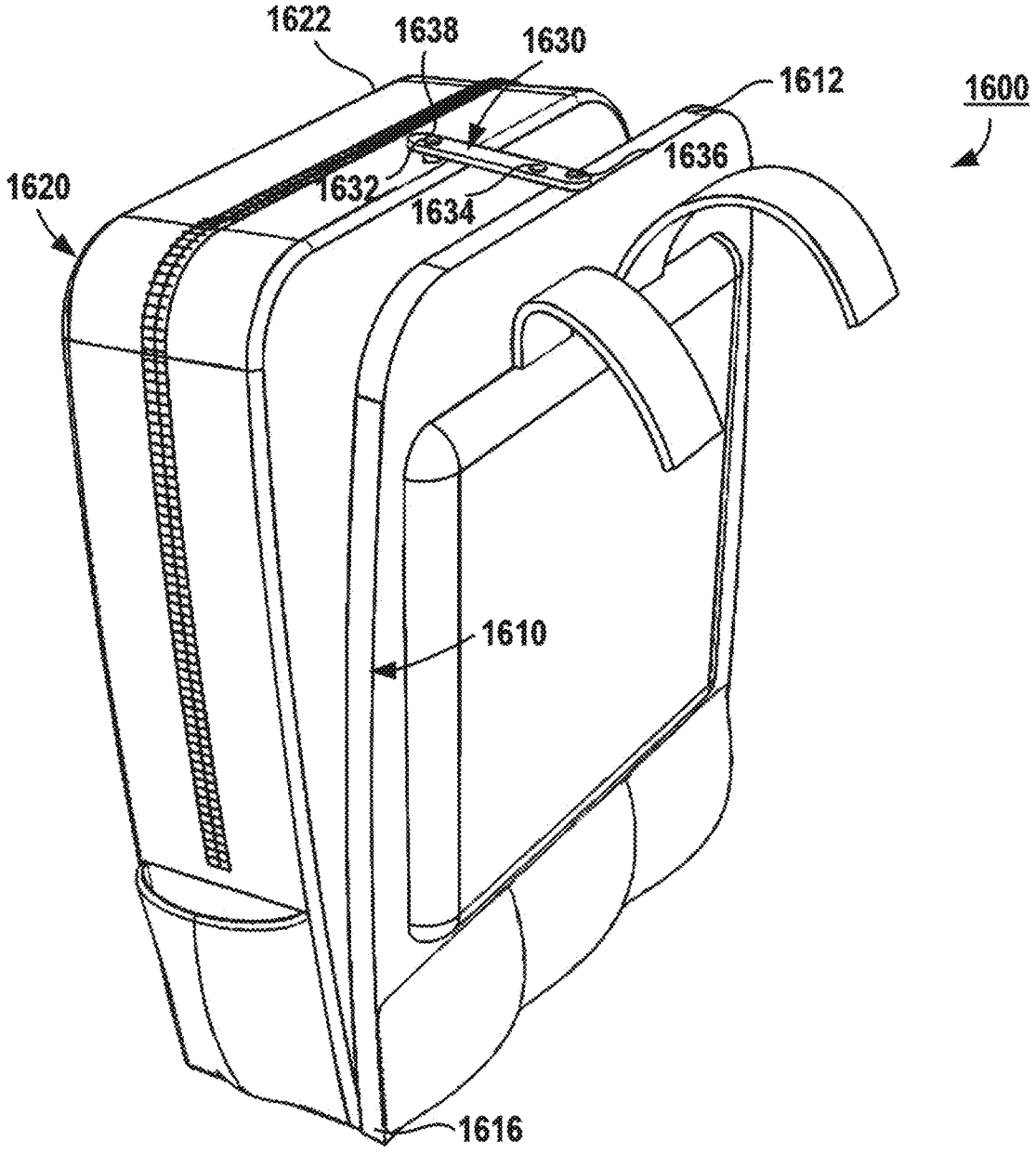
FIG. 16A is a partial perspective view of a backpack of a sixteenth embodiment of the present disclosure.
Figure 16B:
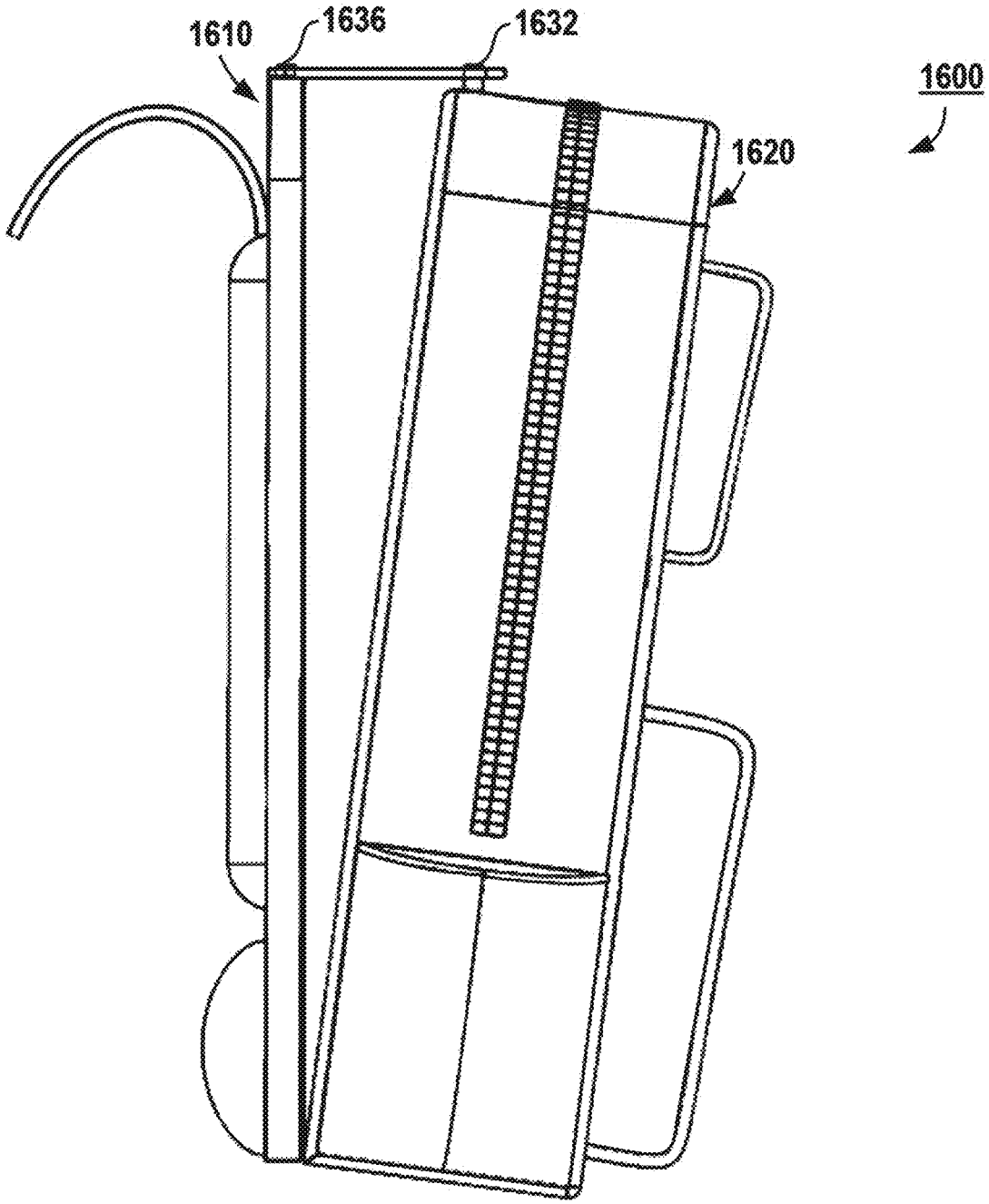
FIG. 16B is a side view of the backpack of the sixteenth embodiment of the present disclosure.

FIGS. 16A and 16B are a partial perspective view and a side view of a backpack 1600 of a sixteenth embodiment of the present disclosure. The backpack 1600 includes a longitudinal supporting element 1610, a main body 1620, and a transverse connector 1630. The main body 1620 can be screwed onto a second end 1616 of the longitudinal supporting element 1610 by suture line, and the main body 1620 is inclined relative to the longitudinal supporting element 1610. The longitudinal supporting element 1610 connects a top end 1622 of the main body 1620 and a first end 1612 of the longitudinal supporting element 1610. In the present embodiment, the transverse connector 1630 connects with the longitudinal supporting element 1610 through a fastening piece 1636. The transverse connector 1630 includes a first through hole 1634 and a second through hole 1638, a fixed bolt 1632 provided on a top end 1622 of the main body 1620 may through the first through hole 1634 or the second through hole 1638, thus connecting the main body 1620 and the longitudinal supporting element 1610 at a position of the first end 1612.

When the fixed bolt 1632 passed through the second through hole 1638, the main body 1620 is inclined relative to the longitudinal supporting element 1610, and maintain the inclination by the suture line between the transverse connector 1630 and the main body 1620. When the fixed bolt 1632 passed through the first through hole 1634, the main body 1620 is parallel and fit to the longitudinal supporting element 1610, and in a non tilted position. A skill person in this filed can expect that to set more holes on the transverse connector 1630, leading an adjustment of inclined angle will be more diverse.

Figure 17A:
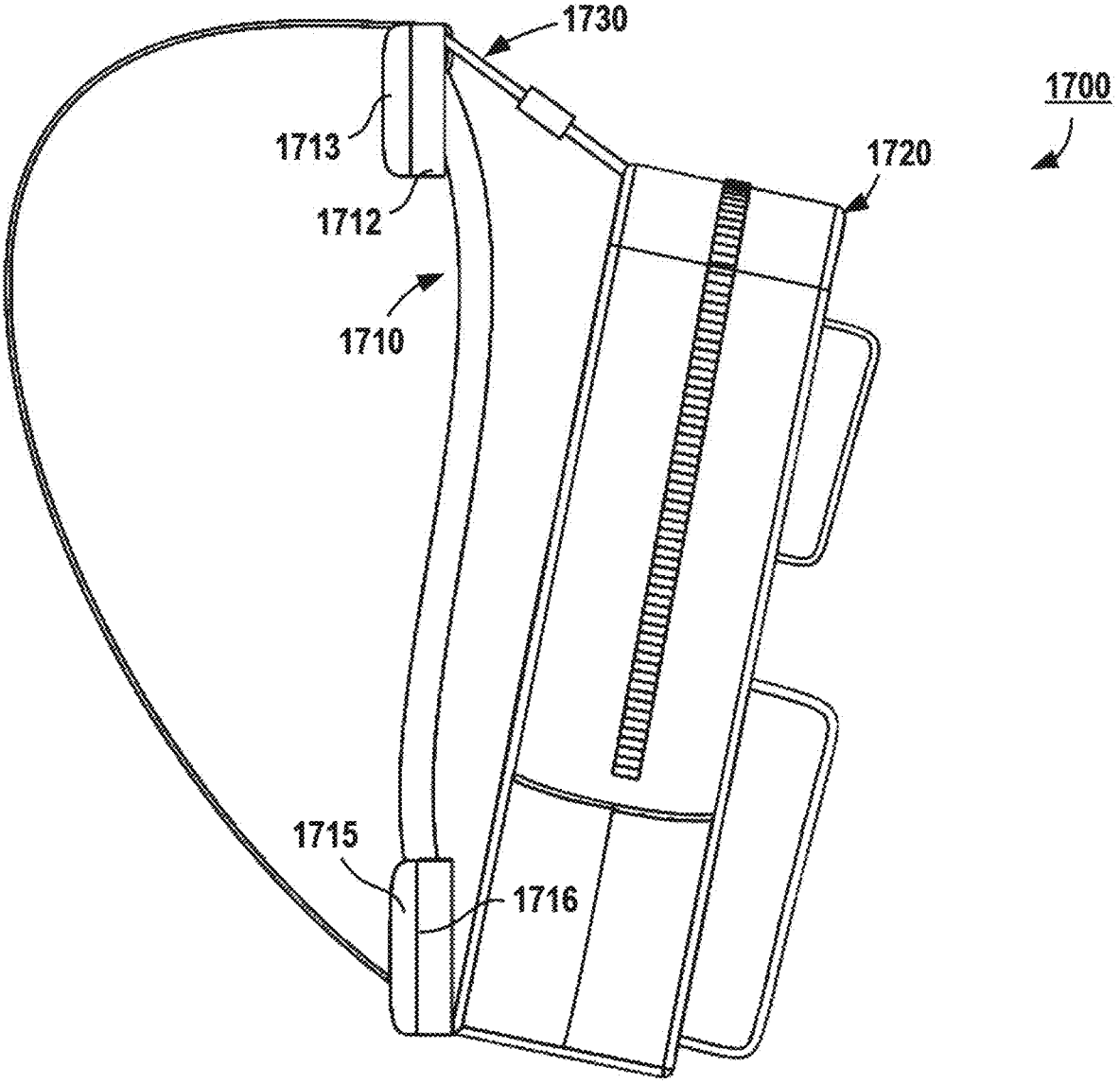
FIG. 17A is a side view of a backpack of a seventeenth embodiment of the present disclosure.
Figure 17B:
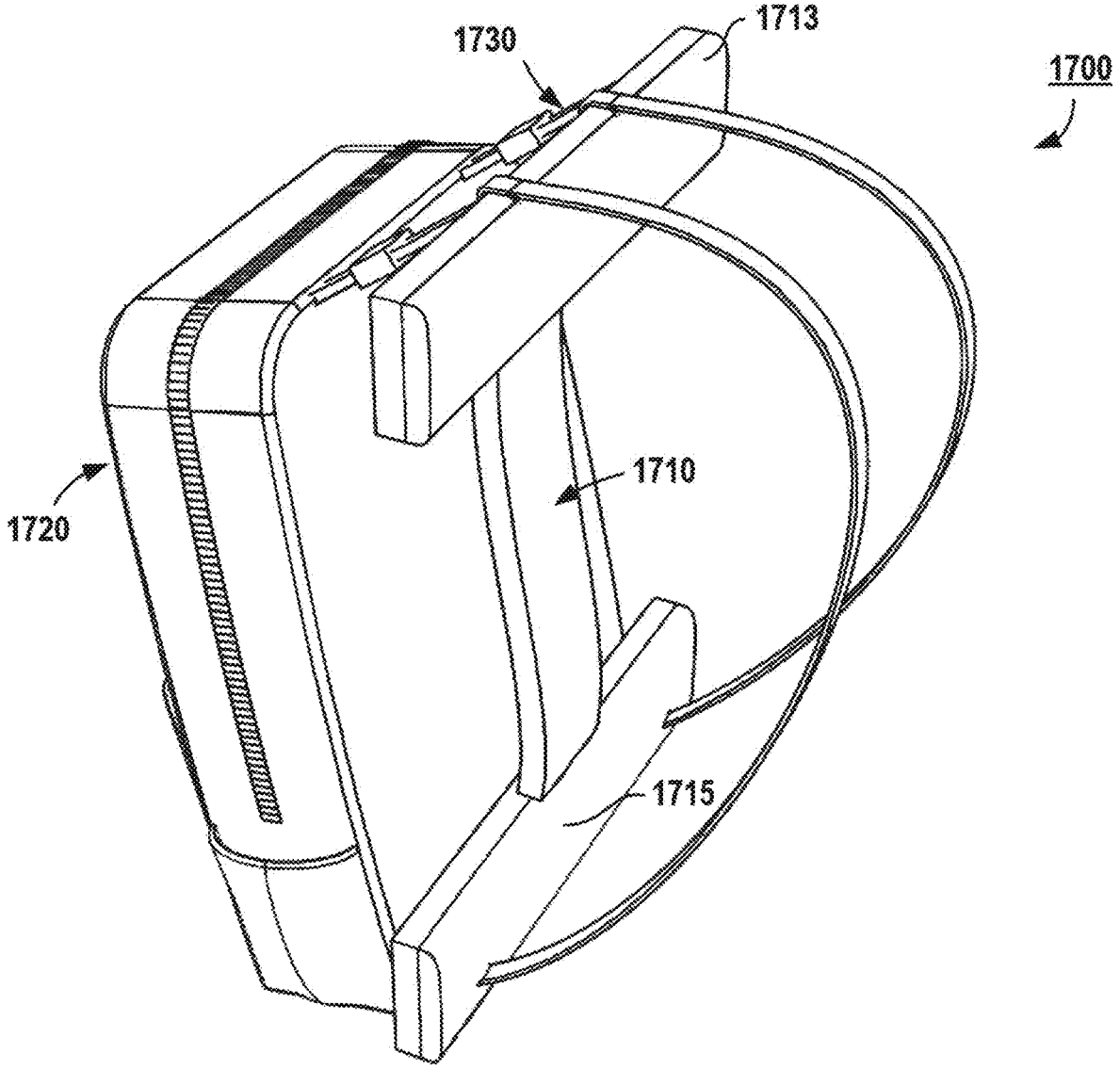
FIG. 17B is a partial perspective view of the backpack of the seventeenth embodiment of the present disclosure.

FIGS. 17A and 17B are a side view and a partial perspective view of a backpack 1700 of a seventeenth embodiment of the present disclosure. The backpack 1700 includes a longitudinal supporting element 1710, a main body 1720, and a transverse connector 1730. The main body 1720 can be screwed onto a second end 1716 of the longitudinal supporting element 1710 by suture line, and the main body 1720 is inclined relative to the longitudinal supporting element 1710. The longitudinal supporting element 1710 is designed to have an ergonomic shape to better fit the natural curvature of the human spine. A first buffer pad 1713 and a second buffer pad 1715 are connected to a first end 1712 and a second end 1716 of the longitudinal supporting element 1710, respectively. Alternatively, the longitudinal supporting element 1710 can be wrapped in fabric and filled with elastic filling material, but the overall ergonomic shape remains after the fabric is wrapped and filled.

Figure 18:
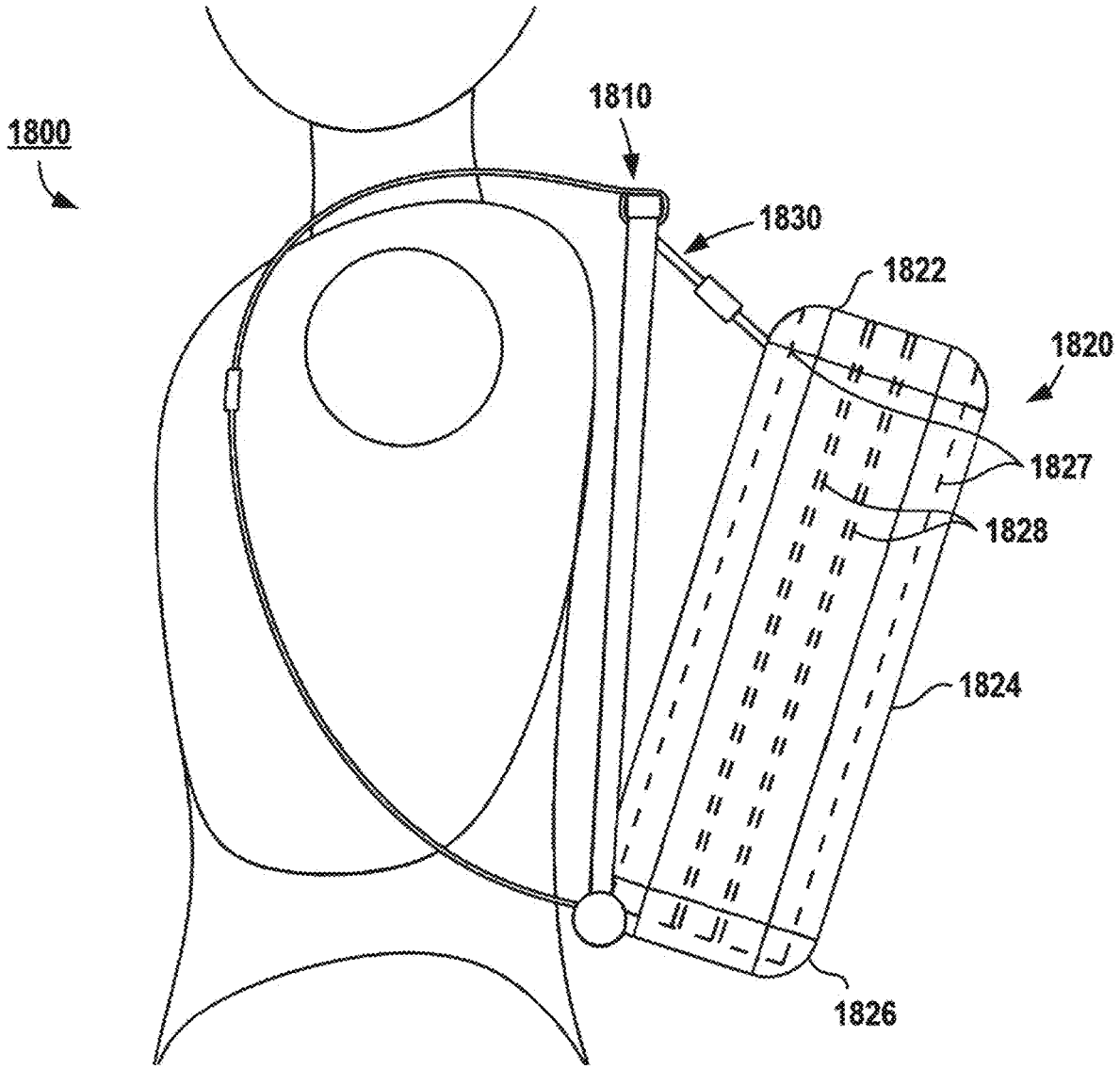
FIG. 18 is a side view of a backpack of an eighteenth embodiment of the present disclosure.

FIG. 18 is a side view of a backpack 1800 of an eighteenth embodiment of the present disclosure. The backpack 1800 includes a longitudinal supporting element 1810, a main body 1820, and a transverse connector 1830. The main body 1820 is inclined relative to the longitudinal supporting element 1810. The main body 1820 includes a top end 1822, a bottom end 1826 and a middle part 1824. In the present embodiment, an internal space of the main body 1820 is divided vertically into three independent sub-spaces by two pieces of first hard materials 1828. The main body 1820 may also include two second hard materials 1827 located around the interior space, providing sufficient rigidity for the main body 1820 without deformation. The second hard materials 1827 and the first hard materials 1828 extend along the entire longitudinal direction of the main body 1820.

The first hard materials 1828 and the second hard materials 1827 play a role in separating space. When accommodating a large number of items, the first hard materials 1828 and the second hard materials 1827 is configured to ensure that the items incline along a direction along the first hard materials 1828 (or the second hard materials 1827), which is the same as the tilt direction of the main body 1820 relative to the longitudinal supporting element 1810, to ensure that the weight reduction and correction effects caused by the main body tilt setting are not offset by the items.

Figure 19:
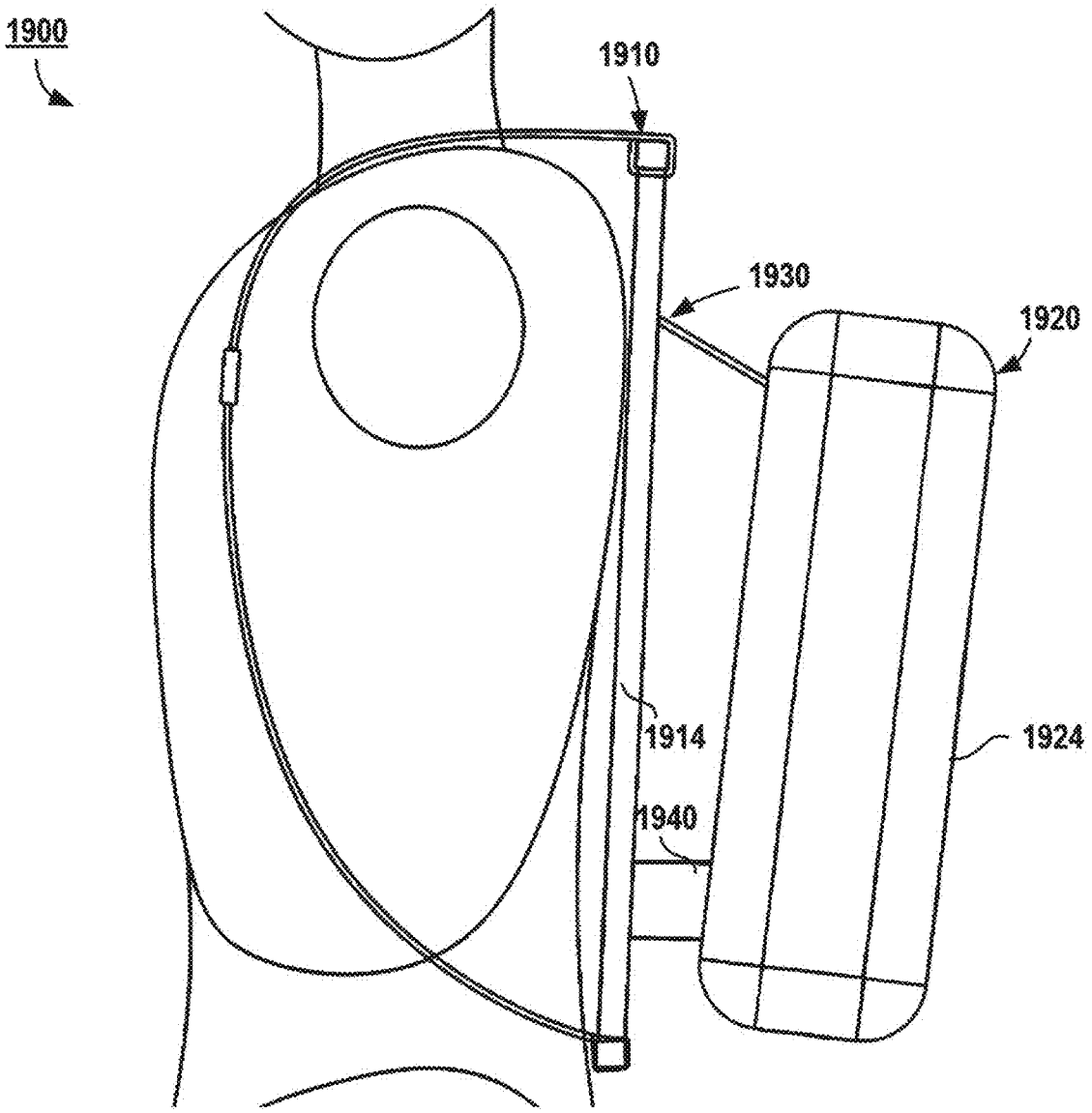
FIG. 19 is a side view of a backpack of a ninthteenth embodiment of the present disclosure.

FIG. 19 is a side view of a backpack 1900 of a ninthteenth embodiment of the present disclosure. The backpack 1900 includes a longitudinal supporting element 1910, a main body 1920, and a transverse connector 1930. In the present embodiment, the backpack also includes a supporting component 1940, the supporting component 1940 is connected to a middle part 1924 of the main body 1920 and an intermediate portion 1914 of the longitudinal supporting element 1910. In this embodiment, the supporting component 1940 is an elastic element, such as a spring or airbag, which on the one hand provides at least a portion of the support for the main body 1920, and on the other hand provides a buffering effect for the main body 1920 on the longitudinal supporting element 1910 (and the buffering effect is applied on the user's waist and back). This buffering effect, together with the buffering element (such as a buffer pad) provided by the longitudinal supporting element 1910 on the side near the user's waist and back, improve user comfort.

Figure 20:
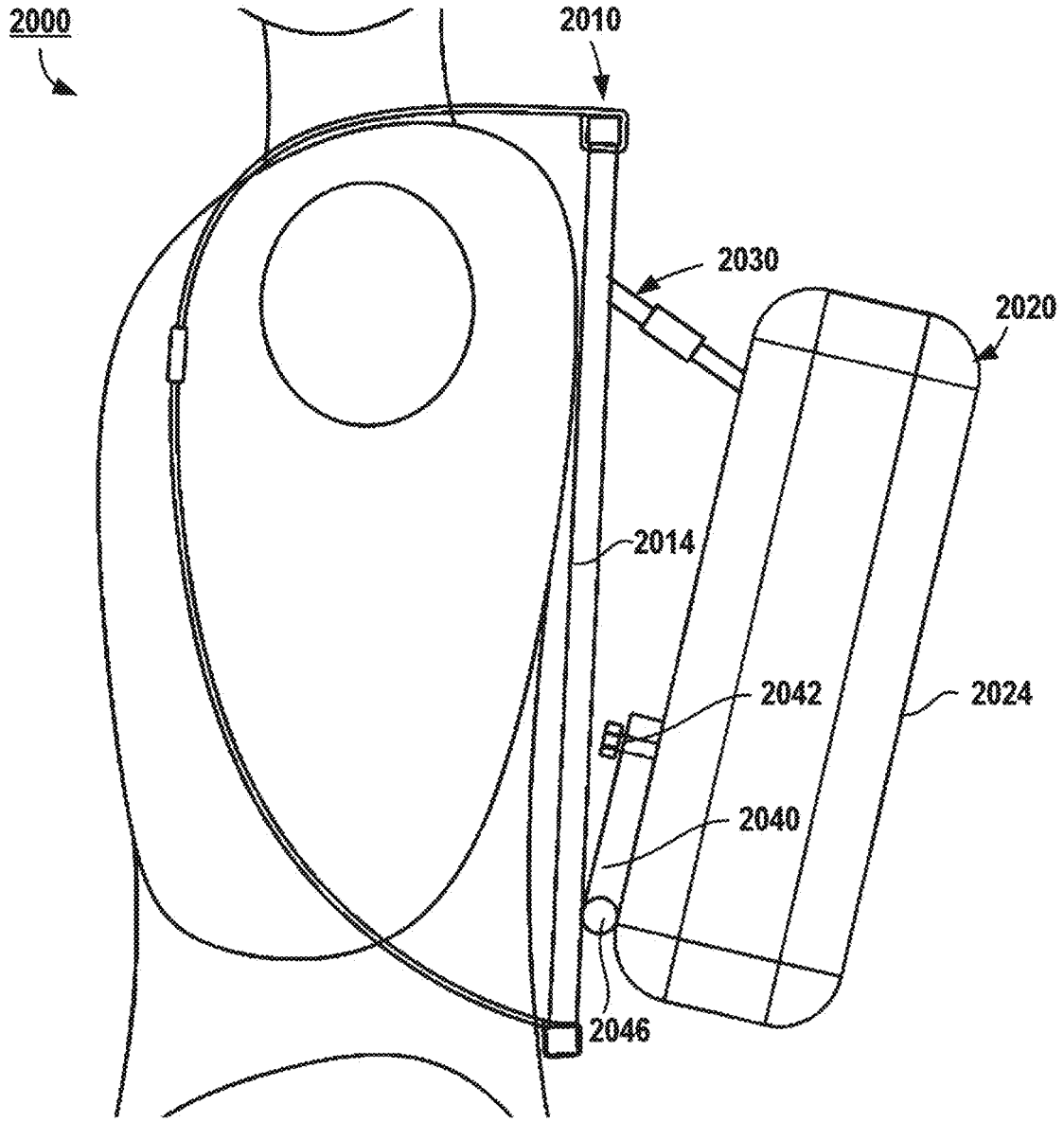
FIG. 20 is a side view of a backpack of a twentieth embodiment of the present disclosure.

FIG. 20 is a side view of a backpack 2000 of a twentieth embodiment of the present disclosure. The backpack 2000 includes a longitudinal supporting element 2010, a main body 2020 and a transverse connector 2030. The supporting component 2040 is connected to a middle part 2024 of the main body 2020 and an intermediate portion 2014 of the longitudinal supporting element 2010. The supporting component 2040 may connect to the main body 2020 through a fastening piece 2042. In this embodiment, the supporting component 2040 rotates around the rotating shaft 2046 relative to the longitudinal supporting element 2010, thereby adjusting the inclined angle of the main body 2020 relative to the longitudinal supporting element 2010. In this embodiment, the inclined angle between the supporting component 2040 and the longitudinal supporting element 2010 is sharp and the inclined angle between the supporting component 2040 and the longitudinal supporting element 2010 is the same as that of the main body 2020 and the longitudinal supporting member 2010.

Figure 21:
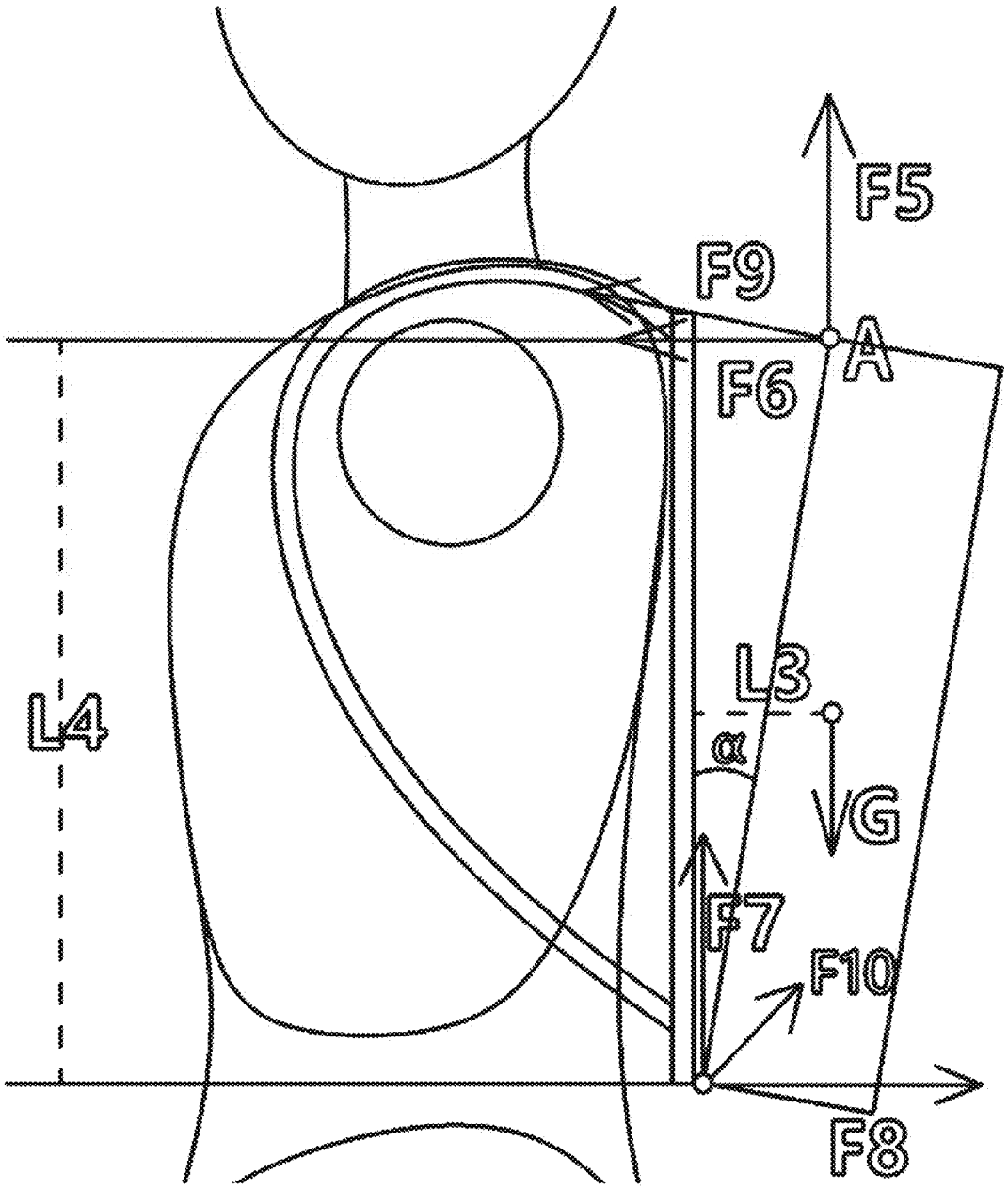
FIG. 21 is a force analysis diagram of the backpack of the present disclosure.

FIG. 21 is a force analysis diagram of the backpack of the present disclosure. As show in the FIG. 21, The main body of the package is balanced by the combined action of gravity G, the tensile force F9 of the transverse connector, and the supporting force F10 of the supporting component. The tensile force F9 of the transverse connector can be decomposed into a component F5 along the gravity direction and a component F6 along the horizontal direction, while the supporting force F10 of the supporting component can be decomposed into a component F7 along the gravity direction and a component F8 along the horizontal direction. On one hand, according to the principle of mechanical equilibrium, F6=F8, and G=F5+F7. During the use of the backpack, the supporting force F10 of the supporting component is partially provided by the user's back or waist, therefore, for the user, the shoulder force (the reacting force of component F5) is at least partially offset by component F7, reducing the shoulder burden. On another hand, through static equilibrium analysis, the equilibrium moment at point A is taken, and the equilibrium equation is obtained: F6*L4=G*L3, that is, F6=G*tan $\alpha$. As tan $\alpha$ increases, F6 becomes larger, leading a greater tensile correction effect on the user's shoulder.

The above are representative examples of the embodiments of the present invention and are provided for illustrative purposes only. One or more technical features expected to be used in one embodiment of the present invention may be added to another embodiment to form an improved or alternative embodiment, provided that they do not violate the purpose of the embodiment. Similarly, one or more technical features used in an implementation can be omitted or replaced to form an alternative or simplified implementation without violating the purpose of the implementation. In addition, one or more technical features used in one embodiment may be combined with one or more technical features in another embodiment to form an improved or alternative embodiment, without violating the purpose of the embodiment. The present invention is intended to include all the improved, alternative, and simplified technical solutions mentioned above.

The invention claimed is:

1. A backpack, wherein the backpack comprising a longitudinal supporting element, a main body and at least one transverse connector;

wherein the longitudinal supporting element comprising a first end and a second end, and an intermediate portion being connected the first end to the second end; when the backpack is carried on a shoulder of a user, the first end is opposite to the shoulder and the second end opposite to a waist of the user;

wherein the main body is independent of the longitudinal supporting element, the main body comprising a top end, a middle part and a bottom end; wherein the top end being opposite to the first end, and the bottom end being opposite to the second end, and a middle part being connected the top end to the bottom end; wherein the main body being inclined relative to the longitudinal supporting element, wherein the top end of the main body is inclined relative to the longitudinal supporting element in a direction away from the longitudinal supporting element; and wherein the transverse connector being configured to connect the longitudinal supporting element to the main body, and at least partially maintaining the inclination of the main body relative to the longitudinal supporting element; and a first lateral spacing between the first end and the top end is greater than a second lateral spacing between the second end and the bottom end, wherein the bottom end of the main body abuts against the longitudinal supporting element or is connected to the longitudinal supporting element via a supporting component.

2. The backpack of claim 1, wherein the transverse connector comprises a first connecting part connected to the longitudinal supporting element, a second connecting part connected to the main body, and an intermediate connecting part, and the intermediate connecting part is configured to connect the first connecting part and the second connecting part;

wherein a spacing between the first connecting part and the second connecting part decreases gradually from the first end of the longitudinal supporting element to the second end.

3. The backpack of claim 1, wherein the backpack further comprises a supporting component independent of the transverse connector;

wherein the supporting component is extended by the longitudinal supporting element and at least partially supporting the main body;

wherein the supporting component is an elastic element or a buffer components.

4. The backpack of claim 3, wherein the supporting component is connected to the second end of the longitudinal supporting element, and the second end is connected to the support component, allowing the supporting component to rotate around the second end; and when the supporting component is rotated around the second end, the inclined angle of the main body relative to the longitudinal supporting element changes accordingly.

5. The backpack of claim 3, wherein the supporting component is provided between a middle portion of the longitudinal supporting element and a middle portion of the main body, and the supporting component extends a first distance from the longitudinal supporting element to increase the second lateral spacing.

6. The backpack of claim 3, wherein the supporting component is configured to connect the second end of the longitudinal supporting element and the bottom end of the main body.

7. The backpack of claim 3, wherein the supporting component is extended laterally out by a second end of the longitudinal supporting element, and the main body is disposed on the supporting component.

8. The backpack of claim 7, wherein the main body is disposed on the supporting component by a first intermediate connector, the first intermediate connector comprises a first part and a second part;

wherein the first part is connected to the main body, the second part is connected to the supporting element, and an inclined angle between the first part and the second part is changed with the rotation of a rotating shaft.

9. The backpack of claim 8, wherein the main body is disposed on the supporting component by the first intermediate connector, wherein the first intermediate connector is in a wedge shape with an oblique surface touching the bottom end of the main body.

10. The backpack of claim 9, wherein a sliding groove is defined on the first intermediate connector, and a fastener is arranged in the sliding groove;

the sliding groove moves along the fastener, to adjust an inclined angle of the inclined surface.

11. The backpack of claim 3, wherein one or more or all of the longitudinal supporting element, the transverse connector and the supporting component are hidden; or one or more or all of the longitudinal supporting element, the transverse connector and the supporting component are exposed.

12. The backpack of claim 11, wherein the backpack comprises a zipper located between the longitudinal supporting element and the main body, the closing and pulling of the zipper resulting in hidden and exposure of the transverse connector.

13. The backpack according to claim 1, wherein the transverse connector is made a filling material.

14. The backpack of claim 1, wherein a lateral width of the transverse connector is adjustable at a predetermined interval.

15. The backpack of claim 14, wherein the backpack also comprises a strap connected to the longitudinal supporting element and a strip connecting the main body to the strap, the strip is connected to the strap in different locations.

16. The backpack of claim 1, wherein the transverse connector is at least partially rigid.

17. The backpack of claim 1, wherein the transverse connector is a textile object surrounding and connecting the main body to the longitudinal supporting element.

18. The backpack of claim 1, wherein the main body is switched between an inclined position and a non-inclined position.

19. The backpack of claim 1, wherein the variation range of the inclined angle between the main body and the longitudinal supporting element is greater than 0° and less than 90°.

20. The backpack of claim 1, wherein an internal space of the main body is separated into at least two subspaces by at least one hard sheet.

* * * * *